US005287875A

United States Patent [19]

Otani

[11] Patent Number: 5,287,875

[45] Date of Patent: Feb. 22, 1994

[54] DRAINING PUMP SYSTEM AND DRAINAGE PREFERENCE OPERATING METHOD THEREFOR

[75] Inventor: Kenji Otani, Tsuchiura, Japan

[73] Assignee: Hitachi, Ltd., Tokyo, Japan

[21] Appl. No.: 796,682

[22] Filed: Nov. 25, 1991

[30] Foreign Application Priority Data

Nov. 27, 1990 [JP] Japan ..... 2-324354

[51] Int. Cl.[5] ..... F04D 15/00

[52] U.S. Cl. ..... 137/15; 137/567; 364/184; 364/509; 417/53

[58] Field of Search ..... 364/184, 508, 509, 511; 137/15, 565, 566, 567; 417/53

[56] References Cited

U.S. PATENT DOCUMENTS 4,918,585 4/1990 Miller ..... 364/509 X 5,166,874 11/1992 Nomaru ..... 364/184

FOREIGN PATENT DOCUMENTS 2-94992 11/1989 Japan .

OTHER PUBLICATIONS

"Pump Plant Failure Diagnosis System", Mitsubishi Heavy Industries Technical Report; vol. 26, No. 2; Mar. 1989.

Japanese Patent Unexamined Publication No. 1-294992 Nov. 1989.

*Primary Examiner*—Robert G. Nilson

*Attorney, Agent, or Firm*—Antonelli, Terry, Stout & Kraus

[57] ABSTRACT

When any component equipment of a draining pump plant is failed, the present necessity of drainage and a failure level of a drain pump involved with the failure are evaluated to determine conditions of continuing or stopping operation of the drain pump involved with the failure on the basis of the evaluated values. When the necessity of continuing the drainage operation is high, the operation is continued as far as possible, taking into account the pump failure level. The possibility of the drainage preference operation is thus maximized in the case of not only a minor failure but also a major failure of the pump, for preventing damage from a flood.

28 Claims, 17 Drawing Sheets

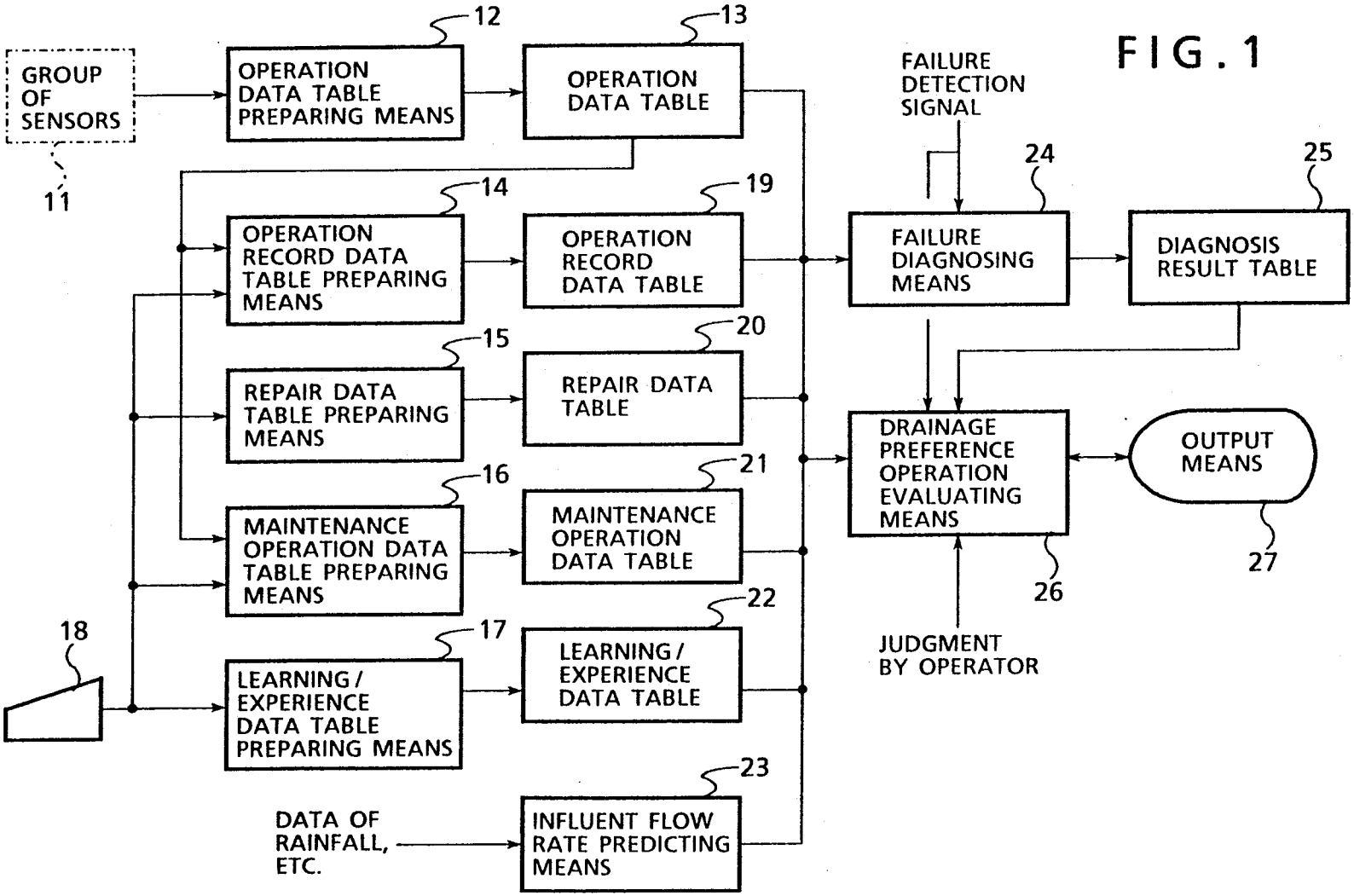
FIG. 1
GROUP OF SENSORS
11
OPERATION DATA TABLE PREPARING MEANS
12
OPERATION DATA TABLE
13
OPERATION RECORD DATA TABLE PREPARING MEANS
14
OPERATION RECORD DATA TABLE
19
REPAIR DATA TABLE PREPARING MEANS
15
REPAIR DATA TABLE
20
MAINTENANCE OPERATION DATA TABLE PREPARING MEANS
16
MAINTENANCE OPERATION DATA TABLE
21
LEARNING/ EXPERIENCE DATA TABLE PREPARING MEANS
17
LEARNING/ EXPERIENCE DATA TABLE
22
18
INFLUENT FLOW RATE PREDICTING MEANS
23
DATA OF RAINFALL, ETC.
FAILURE DETECTION SIGNAL
FAILURE DIAGNOSING MEANS
24
DIAGNOSIS RESULT TABLE
25
DRAINAGE PREFERENCE OPERATION EVALUATING MEANS
26
OUTPUT MEANS
27
JUDGMENT BY OPERATOR

FIG. 4

| PRESENT OPERATION DATA (PUMP No.i) | | |
|---|---|---|
| DATA ITEM | OPERATION START (DATE,Hr,Min) | DATA AT EACH PERIODIC TIME 0Hr 1Hr 2Hr ----- 10Hr |
| INNER WATER LEVEL | | |
| OUTER WATER LEVEL | | |
| ACTUAL LIFT | | |
| R.P.M. | | |
| DELIVERY VALVE OPENING DEGREE | | |
| ⋮ | | |
| PUMP VIBRATION | | |
| NOISE | | |
| ⋮ | | |
| OPERATING STATE | | |

FIG. 5

| OPERATION RECORD DATA (PUMP No.i) | | |
|---|---|---|
| DATA ITEM | OCCURRENCE DATE | DATA AT EACH PERIODIC TIME 0Hr 1Hr 2Hr ----- 20Hr --- |
| $a_1$ | | |
| $a_2$ | | |
| $a_3$ | | |
| ⋮ | | |

FIG. 6

| REPAIR DATA TABLE (PUMP No.i) | |
|---|---|
| ITEM | DATE |
| DELIVERY OF PUMP | |
| TRIAL OPERATION | |
| REPLACEMENT OF BEARING | |
| REPLACEMENT OF SLEEVE | |
| REPLACEMENT OF IMPELLER | |
| ⋮ | |

FIG. 7

| MAINTENANCE OPERATION DATA TABLE (PUMP No.i) | | | | | | | | |
|---|---|---|---|---|---|---|---|---|
| ITEM | DATE | PUMP VIBRATION | DELIVERY PRESSURE | Etc. | PRIME MOVER VIBRATION | HYD. PRESSURE | Etc. | ••• ••• |
| TRIAL OPERATION | | | | ••• ••• | | | ••• ••• | |
| MAINTE-NANCE OPERATION | | | | | | | | |

| LEARNING / EXPERIENCE DATA TABLE | |
|---|---|
| FAILURE ITEM | MESSAGE DATA |
| VIBRATION | LOWERING R.P.M. TO $N_1$ REDUCES VIBRATION TO $V_1$ |
| ⋮ | |

| LIST OF FAILURE FACTORS | | |
|---|---|---|
| FAILURE FACTOR | PROBABILITY % | RISK FACTOR α |
| LUBRICATING OIL PRESSURE | | 0.5 |
| COOLING WATER PRESSURE | | 0.7 |
| AIR PRESSURE | | 1.0 |
| LUBRICATING OIL TEMPERATURE | | 0.8 |
| COOLING WATER TEMPERATURE | | 1.0 |
| BEARING TEMPERATURE | | 0.5 |

| REFERENCE VALUES FOR EMERGENCY STOP (PUMP NO. i) | |
|---|---|
| ITEM | REFERENCE VALUE |
| PUMP VIBRATION NOISE<br>⋮ | |

FIG. 23

| DATA TABLE OF PUMP LIFETIME (PUMP No.i) | | | | |
|---|---|---|---|---|
| PART NAME | AGING LIFETIME | REST OF AGING LIFETIME | OPERATING LIFETIME | REST OF OPERATING LIFETIME |
| | YEARS | YEARS | | |
| CASING | 30 | 30-10 | 200.000 | 190.000 |
| IMPELLER | 20 | $20-10+\frac{10}{2}$ | 100.000 | 95.000 |
| SHAFT | 20 | 20-10 | 100.000 | 90.000 |
| SLEEVE | 20 | 20 (REPLACEMENT) | 50.000 | 50.000 |
| BEARING | 10 | 10 (REPLACEMENT) | 25.000 | 25.000 |
| • • • | | | | |

FIG. 24

| OVERALL EVALUATION |
|---|
| (1) NECESSITY LEVEL OF DRAINAGE : $A = A_1$ [MESSAGE] |
| (2) SPARE PUMP : NONE |
| (3) OPERATION RECORD LEVEL : B = 0.0 |
| (4) FAILURE LEVEL : C = |
| EMERGENCY STOP REFERENCE VALUE = |
| PRESENT VALUE = |
| OPERATION CONTINUABLE TIME X = |
| FAILURE LEVEL Co = |
| FAILURE FACTOR / RISK FACTOR $\alpha$ = |
| (5) NORMALITY LEVEL D = |
| (6) EVALUATION OF LEARNING / EXPERIENCE |

DRAINING PUMP SYSTEM AND DRAINAGE PREFERENCE OPERATING METHOD THEREFOR

BACKGROUND OF THE INVENTION

The present invention relates to a drainage preference operating method which can prevent stop of drain pumps as far as possible and enables a draining pump plant to fulfill its function maximally even when any component equipment of the draining pump plant breaks down, and a draining pump system which implements the operating method.

A draining pump system such as for use in draining pump plants serves to collect water drained off from urban districts, introduce the water into an influent tank, and pump out the water, flowing into the influent tank, to rivers or other watercourses by using a plurality of drain pumps. The draining pump system is comprised of prime movers for driving respective drain pumps, and a group of auxiliaries for supplying fuel, lubricating oil, cooling water, air, etc. to the drain pumps and the prime movers. Because this type draining pump system is generally intended to prevent drainage areas from being flooded, there is a demand to continuously operate the drain pumps as far as possible under a condition of large influent amount even if the pumps are found failed.

As a step to be taken in the even of such a failure, conventional draining pump plants has been designed to divide failures into two categories, i.e., minor and m for failures, as disclosed in Japanese Patent Laid-Open No. 1-294992, for example. More specifically, failures of the type that can be judged as not leading to damages of the equipment for some time to come are grouped as minor ones. In this case, only an buzzer alarm is effected and operation of the relevant drain pump is continued. On the other hand, failures of the type that can be judged as leading to damages of the equipment in a short time are grouped as major ones. In this case, not only an buzzer alarm is effected, but also operation of the relevant drain pump is brought into emergent stop.

For the purpose of earlier restoration from failures, it has also been practiced to install a failure diagnosis device for pursuing the failure cause, or a failure adaptive guidance device for expediting the restoration from failures. One of this type devices is described in, by way of example, "Pump Plant Failure Diagnosis System", Mitsubishi Heavy Industries Technical Report, Vol. 26, No. 2 (March 1989).

In practice, however, judgment on a degree of necessity for operating individual drain pumps and the presence or absence of past operation record under a failed condition is still made only relying upon experiences and perception of an operator. This means that emergent operation of failed drain pumps is performed without definite judgment standards.

Further, the technique of checking the interior of equipment by fiber scopes or judging a normality level of equipment based on analysis of vibrations during the operation has been improved recently. This type technique is however employed just in judging the need of repair.

In the prior art stated above, a degree of failure is evaluated using reference values for failure judgment which are fixedly determined and whether to continue or stop operation of a drain pump is judged on the basis of the evaluation result, taking into account neither the operating state of the drain pump nor a tendency in changes of the failed condition until reaching the reference values for failure judgment. Accordingly, there has suffered from the problem that the drain pump may be stopped even in no need of stopping it in its actual state, thus disabling of cover the amount of water required to be pumped out, or that any equipment may be damaged with undue continuation of the operation.

SUMMARY OF THE INVENTION

An object of the present invention is to provide a drainage preference operating method for a draining pump system by which, in the event of any failure, conditions of continuing or stopping operation of a failed drain pump are rationally judged to prevent unnecessary stop of the drain pump and damages of equipment.

Another object of the present invention is to provide a draining pump system equipped with a drainage preference operating and managing apparatus which can automatically judge conditions of continuing or stopping operation of failed equipment, to thereby improve the reliability.

To achieve the above first object, the drainage preference operating method of the present invention is featured in including at least one of the following items (1) to (5), preferably in a proper combination of those items.

(1) Upon the occurrence of a failure in the draining pump system, a period of time taken for the water level in an influent tank to reach a upper limit if operation of a drain pump involved with the failure is stopped is estimated, the necessity of draining is evaluated depending on a length of the predicted period of time, and conditions of continuing or stopping operation of the failed equipment is determined on the basis of the evaluation.

(2) Upon the occurrence of a failure in the draining pump system, a time-dependent change in the data relating to the failure is predicted based on the operation data of a drain pump involved with the failure, a period of time taken for the predicted data to reach a preset reference value for emergency stop relating to the failure is calculated, a failure level is evaluated depending on a length of the calculated period of time, and conditions of continuing or stopping operation of the failed equipment is determined on the basis of the evaluation.

(3) Upon the occurrence of a failure in the draining pump system, a change in the data relating to the failure is predicted based on both the present operation data of a drain pump involved with the failure and the operation record data for the same failure occurred before, periods of time taken for the predicted data to reach a preset reference value for emergency stop relating to the failure and a limit value in the past operation record, respectively, are calculated, a failure level is evaluated depending on larger one of the two calculated periods of time, and conditions of continuing or stopping operation of the failed equipment is determined on the basis of the evaluation.

(4) In the above item (2) or (3), it is desirable to diagnose the occurred failure for determining failure causes and probabilities of the causes, find out the failure cause with the highest probability, and correct the evaluation of the failure level depending on a risk factor set corresponding to the failure cause found out.

(5) Upon the occurrence of a failure in the draining pump system, a proportion of the remaining lifetime with respect to the rated lifetime of each equipment part of the drain pump involved with the failure is calculated, a normality level of the failed equipment is evaluated depending on the calculated proportions of the remaining lifetimes, and conditions of continuing or stopping operation of the failed equipment is determined on the basis of the evaluation.

In the draining pump system equipped with the drainage preference operating and managing apparatus of the present invention, the above-stated drainage preference operating method is implemented by using a computer.

In this case, the computer includes an operation data table prepared by collecting operation data of drain pump associated equipment, such as the drain pump, a prime mover and a group of auxiliaries, an operation on record data table prepared by collecting data of emergent operation which has been performed upon the occurrence of a failure in the drain pump associated equipment, a repair data table storing therein data of the delivery date and the repaired contents of the drain pump associated equipment, and a maintenance operation data table prepared by collecting trial operation data and subsequent maintenance operation data of the drain pump associated equipment.

The evaluation and judgment in the drainage preference operating and managing apparatus, as well as the control for continuing or stopping operation of the drain pump can be all automatically made. Further, for the purpose of improving reliability of the drainage preference operation, it is possible to provide display means for indicating at least one of the necessity of drainage, the presence or absence of the spare for the drain pump involved with the failure, the presence or absence of the past operation record under the condition similarly failed, the failure level, the operation continuable time, the failure causes, the risk factor, and the normality level, allowing an operator to the indicated evaluation, etc. for taking part in the final judgment.

With the present invention thus arranged, the above objects are achieved as follows.

First, because the necessity of drainage is evaluated based on the period of time taken for the water level in the influent tank to reach the upper limit if operation of the drain pump involved with the failure is stopped, the drainage preference operation can be performed rationally with high reliability with-out intervention of human factors such as experiences of the operator. The presence or absence of the spare pump is of course taken into account in evaluating the necessity of drainage. It is also possible to predict a time-dependent change in the amount of influent water flowing into the draining pump plant, calculate a predicted value of the amount of water required to be discharged on the basis of the prediction, and evaluate the necessity of drainage based on the predicted result. By so doing, the reliability is further improved.

Next, because whether to continue the drainage preference operation or not is evaluated using the failure level determined on the basis of the operation data, the non-flexible judgment based on the fixed reference value in the prior art is avoided and human factors such as experiences of the operator are not intervened in the judging process, thus enabling to achieve the rational and high-reliable drainage preference operation. Specifically, evaluation of the failure level can be made in consideration of the operating state of the equipment, a reference value preset corresponding to the operating state, a trend pattern of the measure data, etc. and, therefore, the failed condition of the relevant equipment can be evaluated more accurately. In addition, by considering the trend pattern as well, it becomes possible to accurately predict a future trend and increase the accuracy of judgment on whether to continue the operation or not.

In the case of taking the operation record data of the same or similar drain pump as or to the drain pump involved with the failure, which have been recorded under a condition of the same failure occurred before, into evaluation of the failure level, the reliability of the evaluation can be further improved. By comparing operation record levels, such as a maximum value, a minimum value and a trend pattern of fluctuations in the measured data which have been recorded during the trial operation and the previous maintenance operation, with the operation data under the present failed condition, for example, whether to continue the operation or not can be evaluated from the standpoint of past record.

Evaluation of the normality level corresponds to use of an index for indicating the present normality of equipment, such as the remaining lifetime of each part of the drain pump involved with the failure. Relying on such an index permits to evaluate the drainage preference operation in a more rational manner. The remaining lifetimes are determined separately from the average lifetimes, history of inspection/repair, and situations of maintenance operation of the parts. A reference value for stopping the drain pump is set for each normality level to make evaluation of whether to continue the operation or not.

Moreover, by adding the events learned or experienced by operators and knowhow possessed by equipment makers for comparison with the events occurred relating to the failure, the judgment on whether to continue the operation or not can be made with higher reliability.

BRIEF DESCRIPTION OF THE DRAWINGS

FIG. 1 is a block diagram showing an entire arrangement of a drainage preference operating and managing apparatus according to one embodiment of the present invention;

FIG. 4 is a diagram showing one example of an operation data table;

FIG. 5 is a diagram showing one example of an operation record data table;

FIG. 6 is a diagram showing one example of a repair data table;

FIG. 7 is a diagram showing one example of a maintenance operation data table;

FIG. 23 is a diagram showing one example of a pump lifetime table; and

FIG. 24 is a diagram showing one example of the contents indicated for overall evaluation.

DESCRIPTION OF PREFERRED EMBODIMENT

Hereinafter, the present invention will be described in conjunction with an illustrated embodiment.

Figure 2:
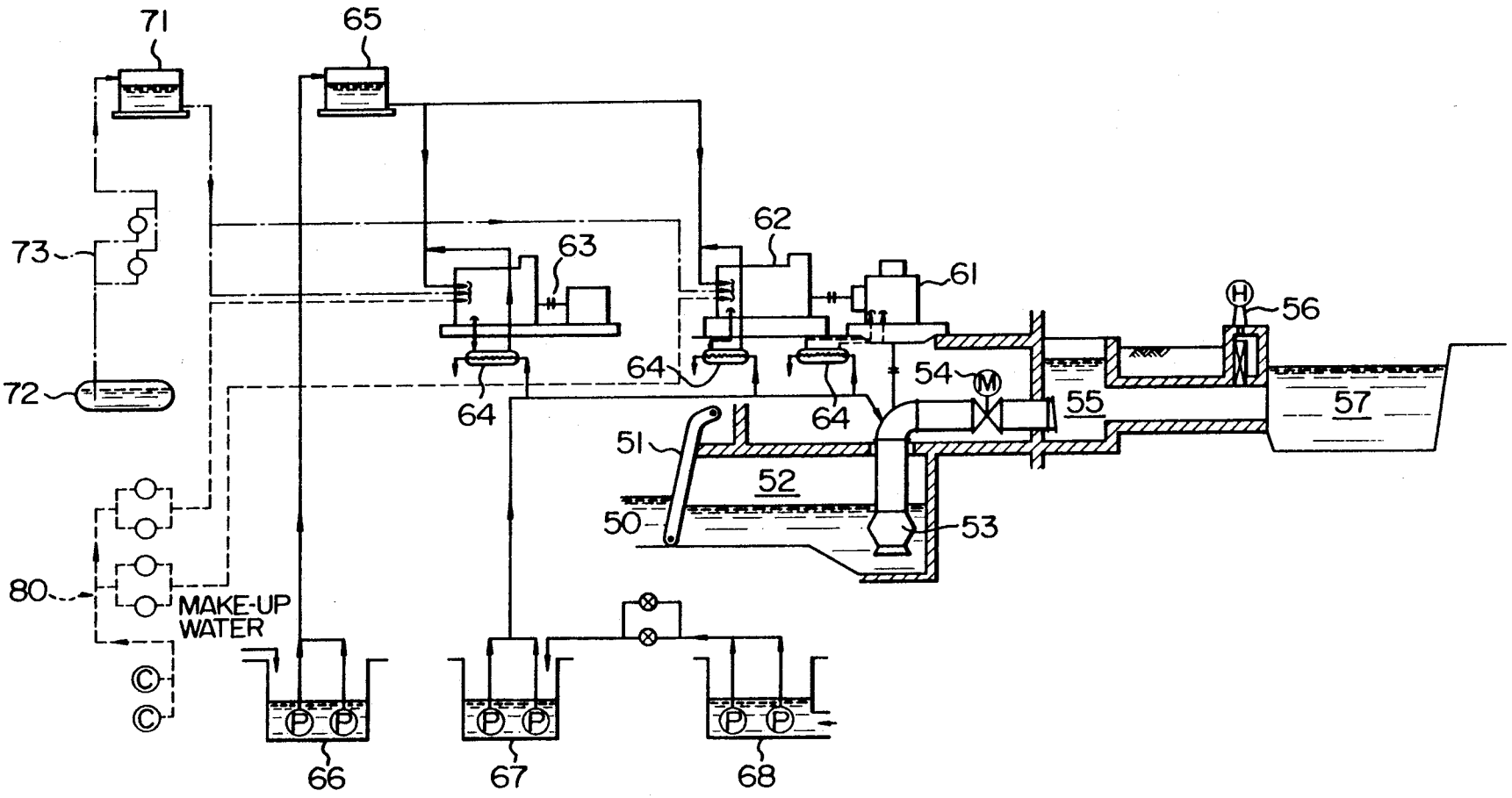
FIG. 2 is a schematic view showing an entire arrangement of one example of a draining pump plant to which the present invention is applied.

FIG. 1 is a functional block diagram of a drainage preference operating and managing apparatus for a draining pump system to which the present invention is applied as one embodiment. FIG. 2 is a schematic view showing an entire arrangement of one example of a draining pump plant.

In the draining pump plant shown in FIG. 2, water collected through drain pipes (not shown) flows into an influent water tank 52 via a dust remover 51. In the influent tank 52, a vertical type drain pump (hereinafter abbreviated as a pump) 53 is installed below an inner water level. A discharge pipe of the pump 53 is communicated with an outside tank via a valve 54. The outside tank 55 is in turn communicated with a river or other water-course 57 with a gate 56 provided therebetween. The pump 53 is driven by a prime mover 62 via a speed reducer 61. The prime mover 62 in this embodiment comprises a diesel engine. An independent power generator 63 driven by a diesel engine is provided for emergency or other purposes. Primary cooling water is circulated to those diesel engines via coolers 64 and the loss of water is replenished from a primary cooling water tank 66 via a elevated water tank 65. On the other hand, secondary cooling water is supplied to the coolers 64 from a secondary cooling water tank 67. The secondary cooling water is also supplied as cooling and sealing water to the pump 53. The secondary cooling water is replenished to the secondary cooling water tank 67 from a raw water tank 68. Fuel is supplied to each of the diesel engines via a fuel dispensing tank 71 and replenished from a fuel storing tank 72 by a fuel feed pump 73. Further, a compressed air supply unit 80 is provided as an air source for start-up.

Figure 3A:
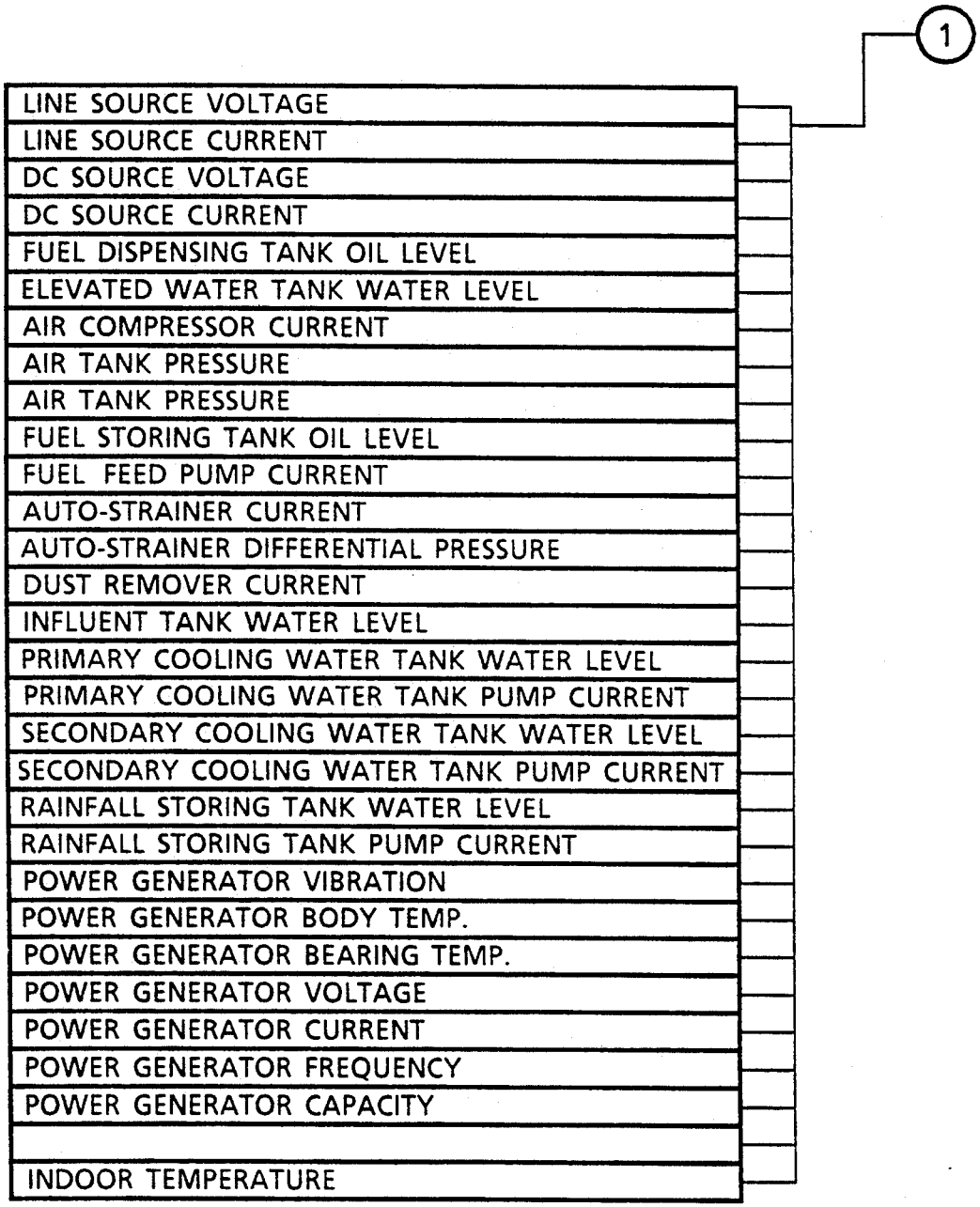
FIGS. 3A and 3B are diagrams showing one example list of measured data.
Figure 3B:
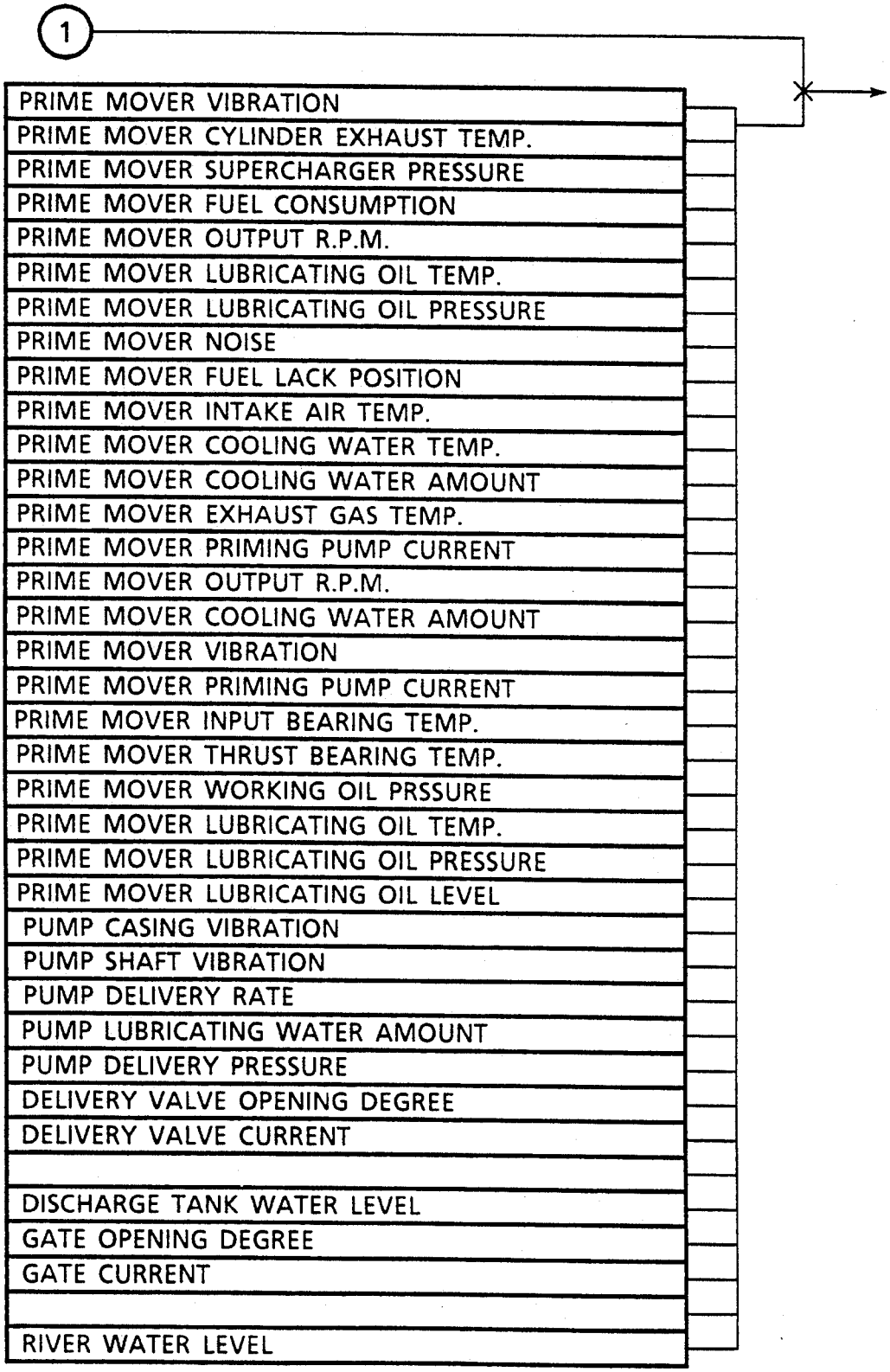
Figures 8, 9:
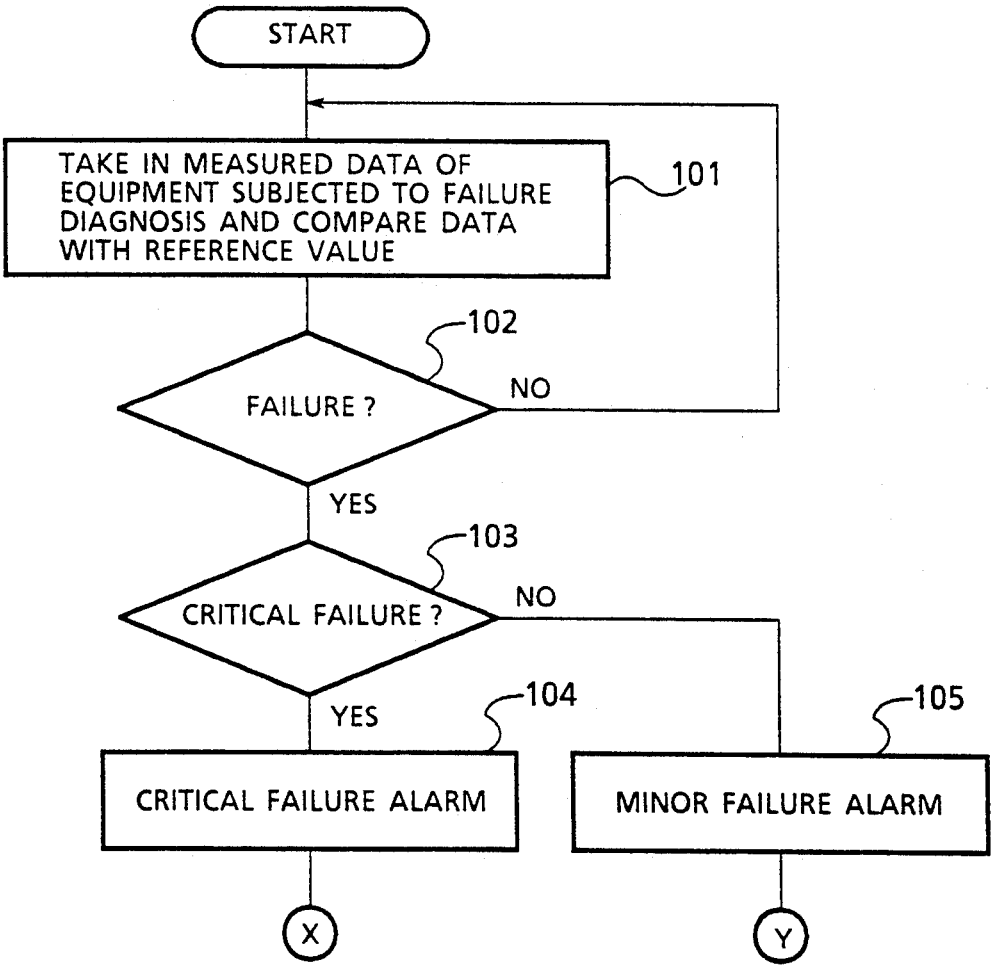
FIG. 8 is a diagram showing one example of a learning/experience data table.
FIG. 9 to 11 are flowcharts showing one example of the steps for evaluating the drainage preference operation according to the present invention.

Meanwhile, in the drainage preference operating and managing apparatus, necessary measured data for the pump, the diesel engines as prime movers, and a group of auxiliaries are inputted from a group of sensors 11 provided in the draining pump system as shown in FIG. 1. One example list of the measured data is shown in FIGS. 3A and 3B. The measured data are taken into operation data table preparing means 12 and then stored in an operation data table 13 through predetermined processing. As shown in FIG. 4, the operation data table 13 is prepared for each pump. Operation record data table preparing means 14 and maintenance operation data table preparing means 16 take in necessary operation data from the operation data table 13, and respective data having the contents as shown in FIGS. 5 and 7 are stored in an operation record data table 19 and a maintenance operation data table 21 through predetermined processing. To the means 14 to 17 for preparing the operation record data, repair data, maintenance operation data and learning/experience data, there are applied commands and data necessary for preparation of those data from input means 18 by an operator. The repair data preparing means 15 processes input data, such as delivery data, contents and data of repair, etc. for equipment associated with the pump, into a predetermined formula as shown in FIG. 6 and then stores the processed data in a repair data table 20. The learning/experience data table preparing means 17 prepares data having the contents as shown in FIG. 8 based on both input commands and data, followed by storing them in a learning/experience data table 22. Influent amount predicting means 23 predicts the influent amount of water flowing into the draining pump plant through the well-known method based on input data of rainfall, etc. When a failure detection signal is applied from a drain pump controller (not shown), failure diagnosing means 24 determines causes and probabilities of the failure through the well-known method and then stores them in a diagnosis result table 25. Drainage preference operation evaluating means 26, as a feature of the present invention, takes in the necessary data from the respective tables and the influent amount predicting means 23, evaluates the necessity of drainage, an operation record level, a failure level, a normality level, a learning/experience level, etc., and then presents conditions of continuing or stopping operation of the pump involved with the failure, etc. to the operator via output means 27 on the basis of the evaluation results. As an alternative, the pump may be directly controlled via the drain pump controller (not shown) in accordance with the conditions of continuing or stopping the pump operation based on the evaluation results of the drainage preference operation evaluating means 26.

Figure 10:
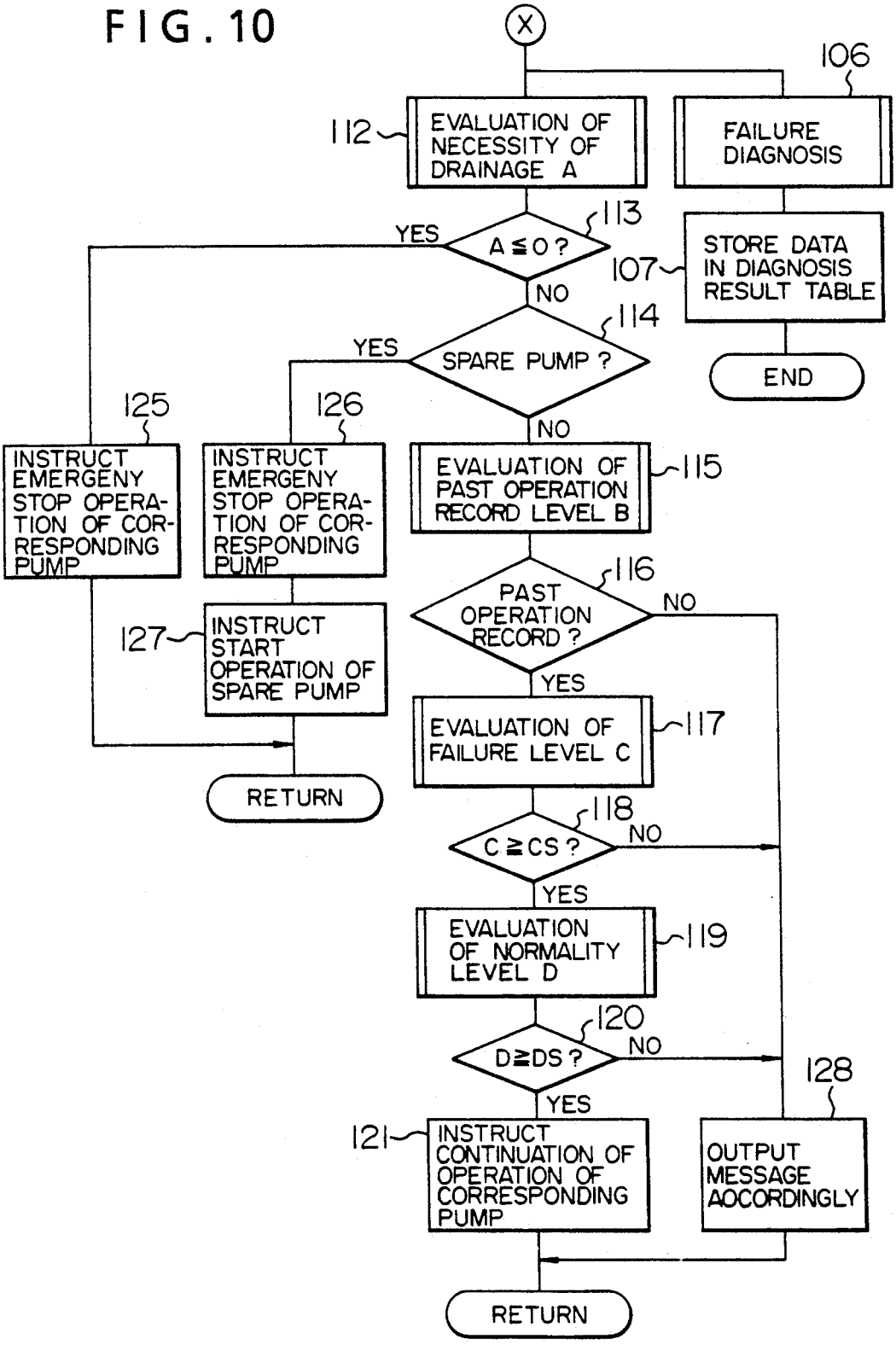
Figure 11:
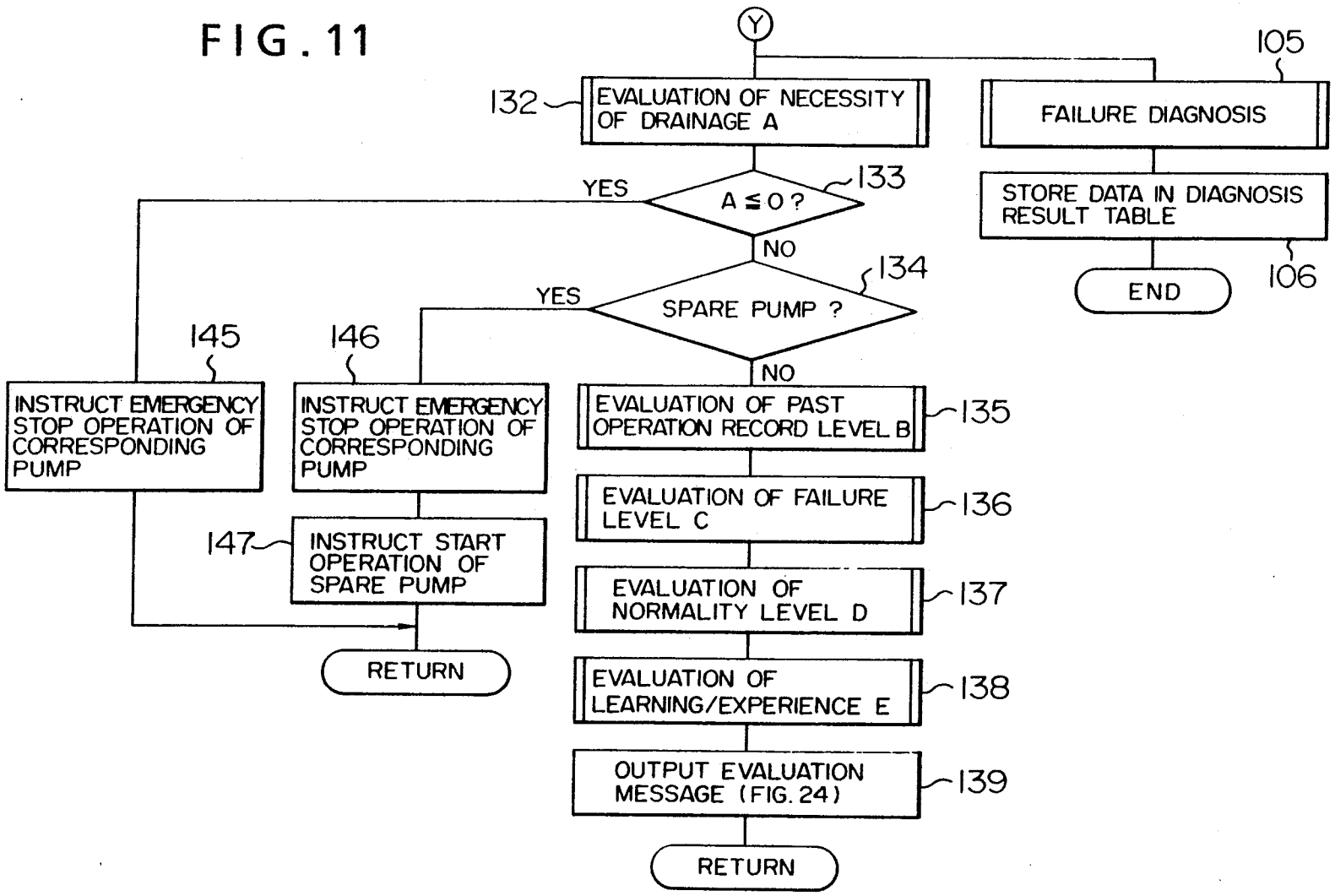
Figure 12:
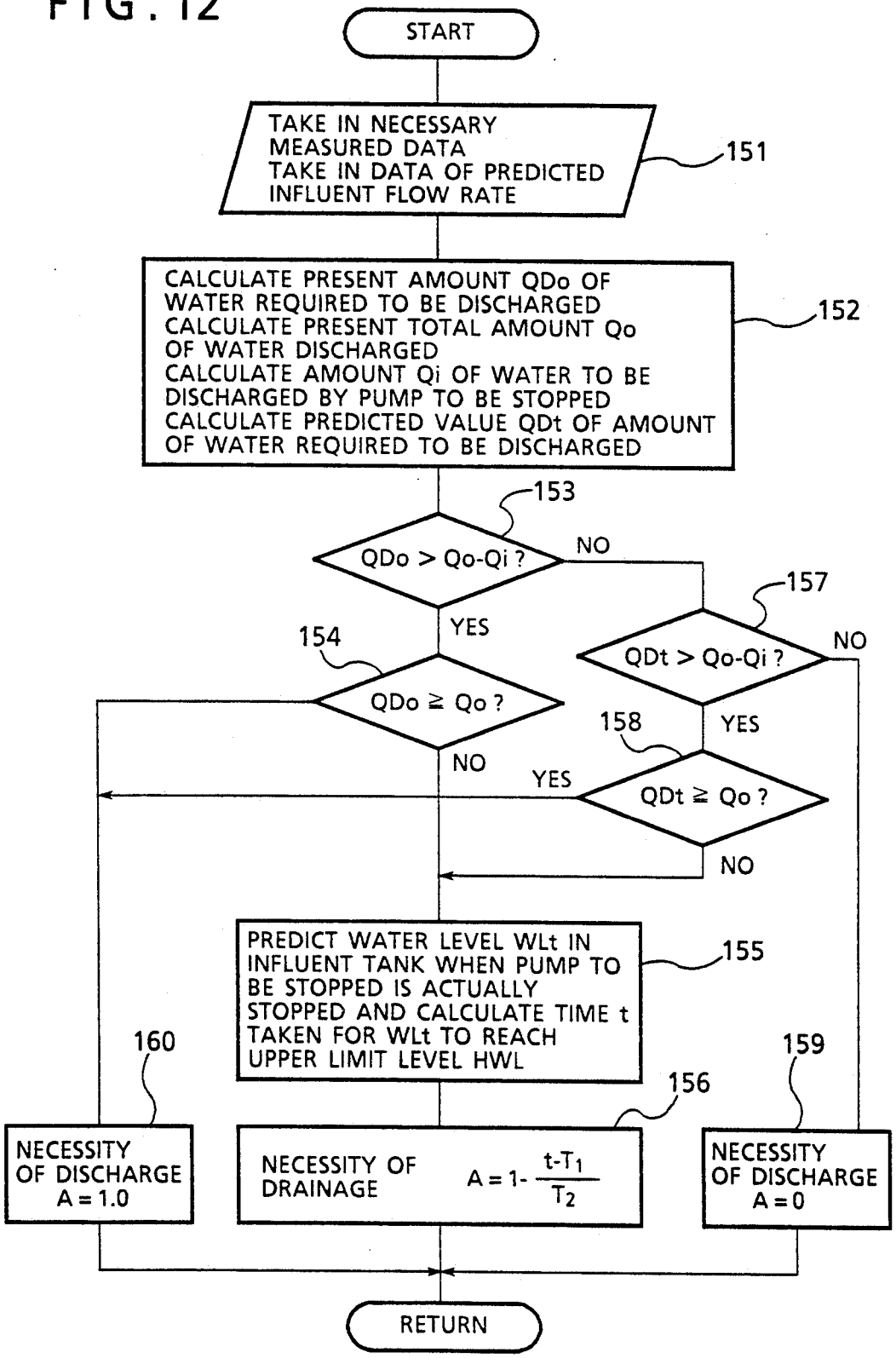
FIGS. 12 to 16 are flowcharts showing one the detailed evaluation steps in respective sections.

Evaluation steps in the drainage preference operation evaluating means 26, as a feature of the present invention, will now be described with reference to flowcharts shown in FIGS. 9 to 16. Of these flowcharts, FIGS. 9 to 11 show the entire processing and FIGS. 12 to 16 show detailed processing steps in primary sections. The process shown in FIG. 9 is incorporated in the drain pump controller (not shown).

Figures 16, 17:
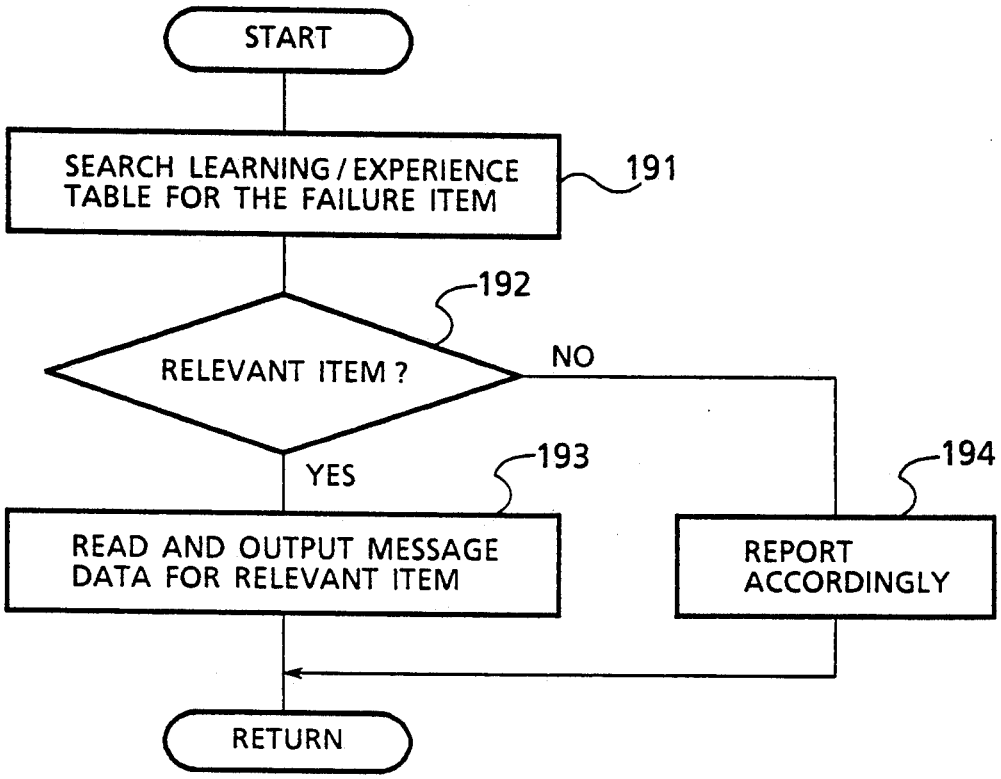
FIG. 17 is a diagram showing one example of a list of failure causes.

As indicated at Steps 101 to 105 in FIG. 9, the measured data of equipment subjected to failure diagnosis are first successively taken in and compared with preset reference values for judgment (i.e., reference values for judging a minor failure) for determining whether the equipment is failed or not. If failed, then whether the failure is major one or not is determined, followed by issuing an alarm depending on the decision result. If the failure is major one, then the control flow goes to the flowchart of FIG. 10, and if the failure is minor one, then the control flow goes to the flowchart of FIG. 11. In any case, the failure diagnosis is executed (Step 106). In the failure diagnosis which can be performed by using the well-known method, failure causes are found out and diagnosis items including probabilities of the respective causes are determined, followed by storing a list of failure causes, which has the contents as shown in FIG. 17, in a diagnosis result table 25 (Step 107). A risk factor $\alpha$ in the list represents a possibility of leading to damages or the like of the equipment if operation of the draining pump system is continued, and is preset for each of the failure causes.

The flowchart of FIG. 10 is started up in the case of the major failure. The entire control flow comprises evaluation of the necessity of drainage A (Step 112), evaluation of the operation record level B (Step 115), evaluation of the failure level C (Step 117), evaluation of the normality level D (Step 119), and outputting of the evaluation result for the drainage preference operation, i.e., an indication of whether to continue or stop the operation, conditions associated with the evaluation, etc. to the output means 27 (Steps 121, 128), followed by returning to the initial state. On the other hand, the flowchart of FIG. 11 is started up in the case of the minor failure and comprises almost the same processing steps as those in FIG. 10. Because the minor failure occurs prior to the major failure and the drain pump is not stopped at once upon the minor failure, both cases are different in that after executing the evaluation for each step, the evaluation result is outputted only for indicating it as a message, and that evaluation of learning/experience E is added at the final step. Note that the output display may be in the form of printing other than indications on a CRT screen.

Processing contents in the above steps will be next explained in more detail one by one. The necessity of drainage A is evaluated in accordance with the sequence shown in FIG. 12. Here, the term "necessity of drainage" corresponds to make evaluation, from the present influent amount or the present water level in the influent tank 52, on whether the amount QDo of water required to be discharged can be covered or not if the pump i involved with the failure is stopped. Specifically, this evaluation is carried out by predicting whether or not the water level in the influent tank is raised up to an upper limit, or how long time it is taken for the water lever to reach the upper limit, if the amount of discharged water is reduced to the value resulted by subtracting the amount Qi of water discharged by the pump i from the total amount Qo of water discharged by all the pumps (i.e., the total of the rated draining capabilities) presently under operation. The amount QDo of water required to be discharged can be determined in various ways. For example, assuming that the upper limit water level in the influent tank 52 is HWL, the total rated draining capabilities of all the pumps is Qmax, and the present water level from a lower limit water level LWL is H, QDo is given by the following equation:

$$QDo = Qmax \cdot H/(HWL - LWL) \quad (1)$$

Figures 18, 19:
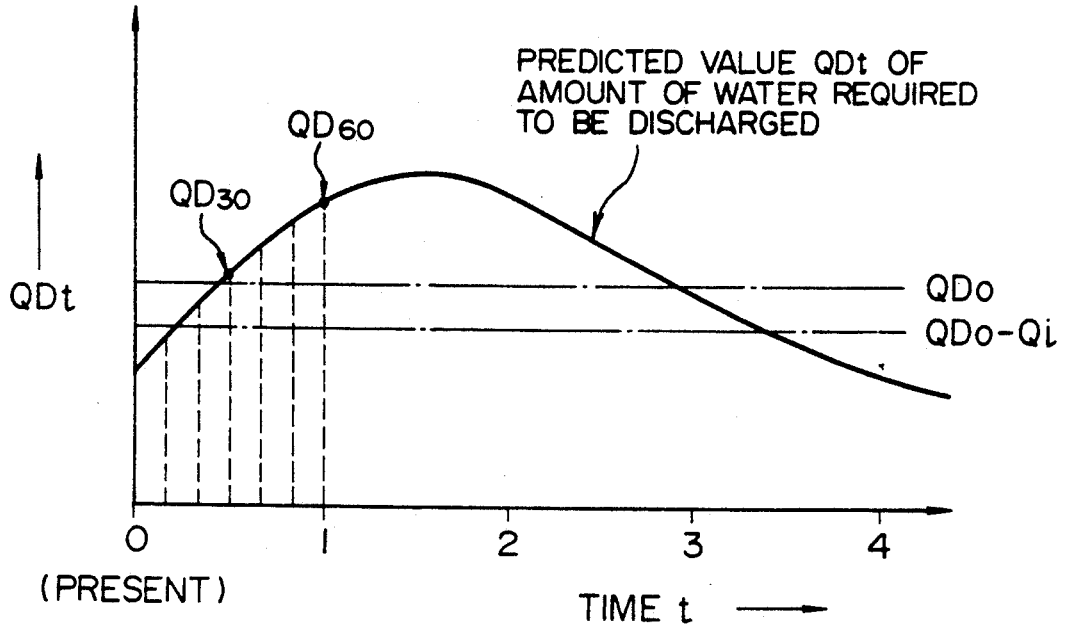
FIG. 18 is a graph for explaining prediction of the amount of water required to be discharged.
FIG. 19 is a diagram showing data example of reference values for emergency stop.

In Step 151, therefore, the necessary measured data and the predicted data of the influent amount are respectively taken from the operation data table 13 and the influent amount predicting means 23. Then, the present amount QDo of water required to be discharged, the present total amount Qo of water discharged, the amount Qi of water discharged by the pump i, and a predicted value QDt of the amount of water required to be discharged if the pump i is stopped, are calculated in Step 152. Here, for the purpose of adding a future change in the influent amount, it is desirable to determine the predicted value QDt of the amount of water required to be discharged, which is a function of time t, based on the predicted data of the influent amount. One example of the predicted value QDt of the amount of water required to be discharged is shown in FIG. 18. Next, in Step 153, whether the QDo is larger than Qo−Qi or not. If the decision is YES, then it is determined whether QDo is not smaller than the present Qo (Step 154). If the decision is YES, this means that the pump i cannot be stopped and, therefore, the necessity of drainage A is evaluated as 1.0 (i.e., A=1.0) (Step 160). On the other hand, if the decision is NO in Step 154, then the water level WLt in the influent tank 52 as resulted if the pump i is stopped is predicted from the following equation, and a period of time t taken for the water level WLt to reach the upper limit HWL (Step 155);

$$\Delta Ht = \Sigma\{QDt - (Qo - Qi)\}/S \quad WLT = WLo + \Delta Ht \quad (2)$$

where ΔHt is a water level lift per unit time, S is a horizontal sectional area of the influent tank 52, and WLo is the present water level. Step 156 then evaluates the necessity of drainage A from the following equation;

$$A = 1 - (t - T_1)/T_2 \quad (3)$$

where $T_1$ is set to 10 minutes and $T_2$ is set to 50 minutes, by way of example. The meaning of $T_1$ is in that when the water level reaches HWL within this time, any measure to recover cannot be taken in time and thus the necessity of drainage is evaluated as 1.0. The meaning of $T_2$ is in that since the failed pump can restart its operation after carrying out simple repair or other measure to recover if the period of time taken for reaching HWL is long, the necessity of drainage is evaluated as 0.0. The above setting of $T_2$ to 50 minutes corresponds to the case where a period of time required for restarting the operation is 60 minutes.

Meanwhile, if the decision in Step 153 is NO, then the similar evaluation to the above is made for the predicted value QDt of the amount of water required to be discharged instead of the present amount QDo of water required to be discharged (Steps 157, 158). If the total amount of water discharged after stopping the pump i is smaller than the predicted value QDt of the amount of water required to be discharged, then the necessity of drainage A is evaluated as 0.0 (i.e., A=0.0) (Step 159), followed by returning to the initial state. The problem to be considered here is the time point t for which the predicted value QDt of the amount of water required to be discharged is calculated. For example, assuming that the period of time required for the operation to restart after stopping the failed pump i and carrying out simple repair or other measure to recover is 60 minutes, it is conceivable to set ½ of 60 minutes, i.e., 30 minutes, as a reference with some allowance. In practice, the time point t is desirably set in match with the actual situations, taking into account various conditions of the draining pump plant.

After evaluating the necessity of drainage A, the control flow goes to Step 113 for determining whether A≦0 is or not. If YES, this means that no trouble will occur even when the failed pump is stopped and, therefore, the process is ended by indicating an action for emergency stop of the failed pump on the output means 27 (Step 125). If A>0 holds, the control flow goes to Step 114 for determining whether a spare pump is present or not. If the spare pump is present, then the control flow goes to Steps 126, 127 where an action for emergency stop of the failed pump and then an action to start the spare pump are indicated on the output means 27, thereby ending the process. If the spare pump is not present, then the control flow goes to Step 115 for executing the evaluation of the operation record level B.

With this embodiment, as explained above, since the necessity of drainage is evaluated based on the period of time taken for the water level in the influent tank to reach the upper limit if operation of the drain pump involved with the failure is stopped, the drainage preference operation can be performed rationally with high reliability owing to no intervention of experiences of the operator. The reliability is further improved by predicting a time-dependent change in the amount of influent water flowing into the draining pump plant, calculating a predicted value of the amount of water required to be discharged on the basis of the prediction, and evaluating the necessity of drainage based on the predicted result.

Figure 13:
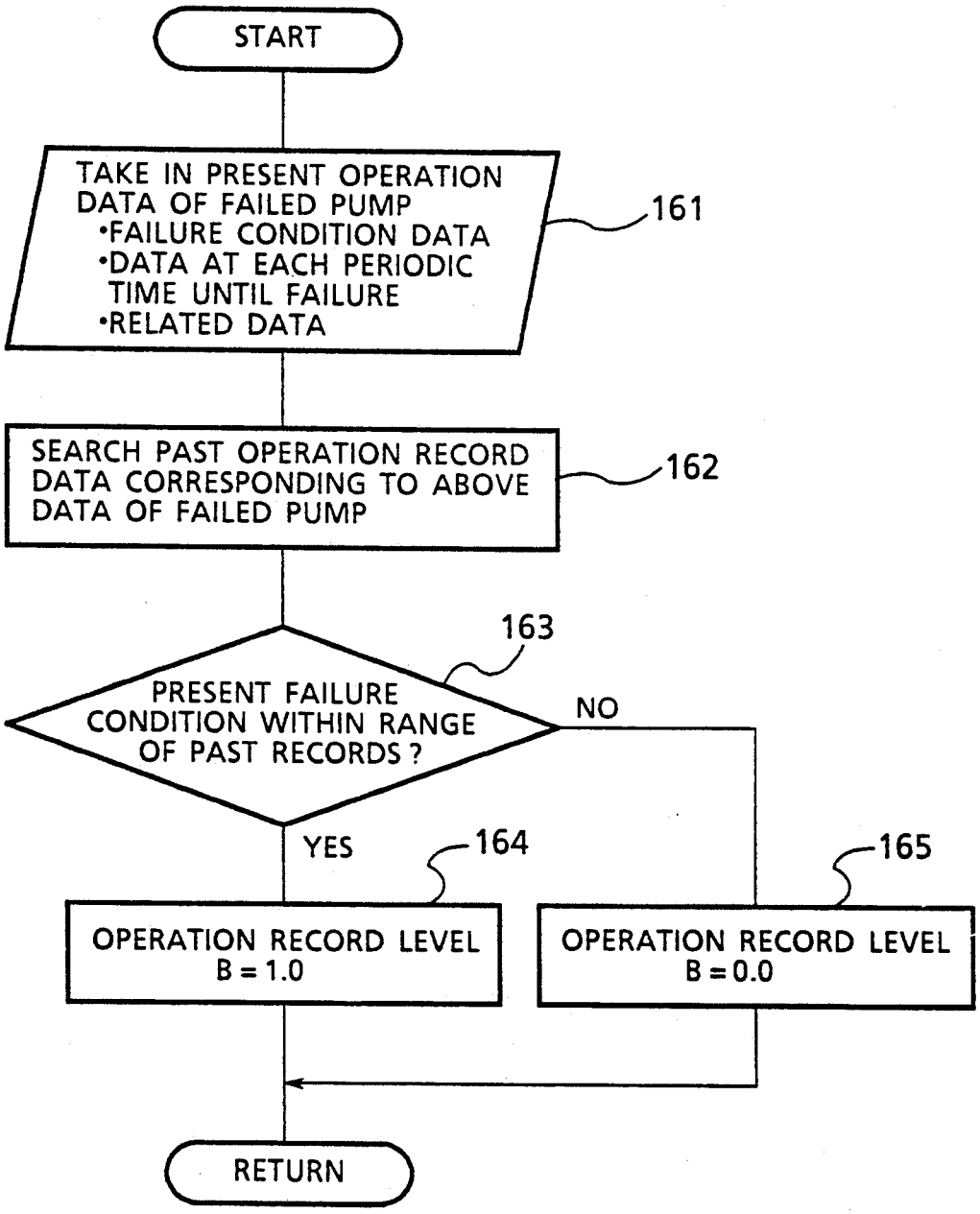

The next evaluation of the operation record level B is intended for referring to the operation data recorded during the past operation of the same or similar equipment under a failed condition, i.e., the maximum and minimum values of the failure data exceeding the reference value or the record data in the bands exceeding upper and lower limit values, and adding judgment on whether the present failed condition falls within the past record range or not, into the evaluation process of the drainage preference operation. More specifically, as shown in the flowchart of FIG. 13, the operation data table 13 is searched in Step 161 to read the failure condition data of the failed pump i, the time-dependent data until the occurrence of the failure and other related data. Next, in Step 162, the operation record data table 19 (FIG. 5) is searched to extract the operation record data relating to the same failure as the failed pump. At this time, if the operation record data about the relevant pump is not present and the operation record data about other pump of the same specification and the same type is present, the latter is extracted. It is then determined in Step 163 whether the present failed condition falls within the record range. If YES, then the control flow goes to Step 164 where the operation record level B is evaluated as 1.0 (B=1.0). If NO, then the control flow goes to Step 165 and the evaluation is ended by setting B=0.0. Typical examples of the operation record data are as follows. The data evaluated using maximum values include various temperature data, vibrations of the pump and so forth, electric currents, etc. For the thrust bearing temperature of the speed reducer 61, by way of example, the reference value for judging a minor failure is 75° C. (rise of 40° C.) and the reference value for judging a major failure is 85° C. However, if the operation record shows the forced operation at 100° C. in the past, the evaluation is made by using it as the reference value. The data evaluated using minimum values include the amount of cooling water for lubricating oil, pressure of lubricating oil, etc. The data evaluated using bands include RPMs (revolution speeds), water levels, oil levels, etc. For example, since there occurs a trouble if RPM of the prime mover 62 is too low or too high, evaluation is made depending on the presence or absence of the operation record in the bands exceeding upper and lower limit values. Although the failed pump was always brought into emergency stop upon the occurrence of a major failure in the past, addition of the above flexible evaluation permits to decide continued execution of the drainage preference operation with high reliability, if the past operation record under a similar failed condition is present. In the case of B=0.0, this means that the past operation record is not present and, therefore, the control flow goes to Step 116 and then Step 128 in FIG. 10 so that the process is ended by outputting the relevant situations and the evaluation result as a message for indication. In the case of B=1.0, the control flow goes to Step 117 for evaluation of the failure level.

With this embodiment, as explained above, since whether to continue the operation or not is evaluated from the standpoint of past record by comparing operation record levels, such as a maximum value, a minimum value and a trend pattern of fluctuations in the measured data which have been recorded during the trial operation and the previous maintenance operation, with the operation data under the present failed condition, the evaluation can be made with higher reliability.

Figure 14:
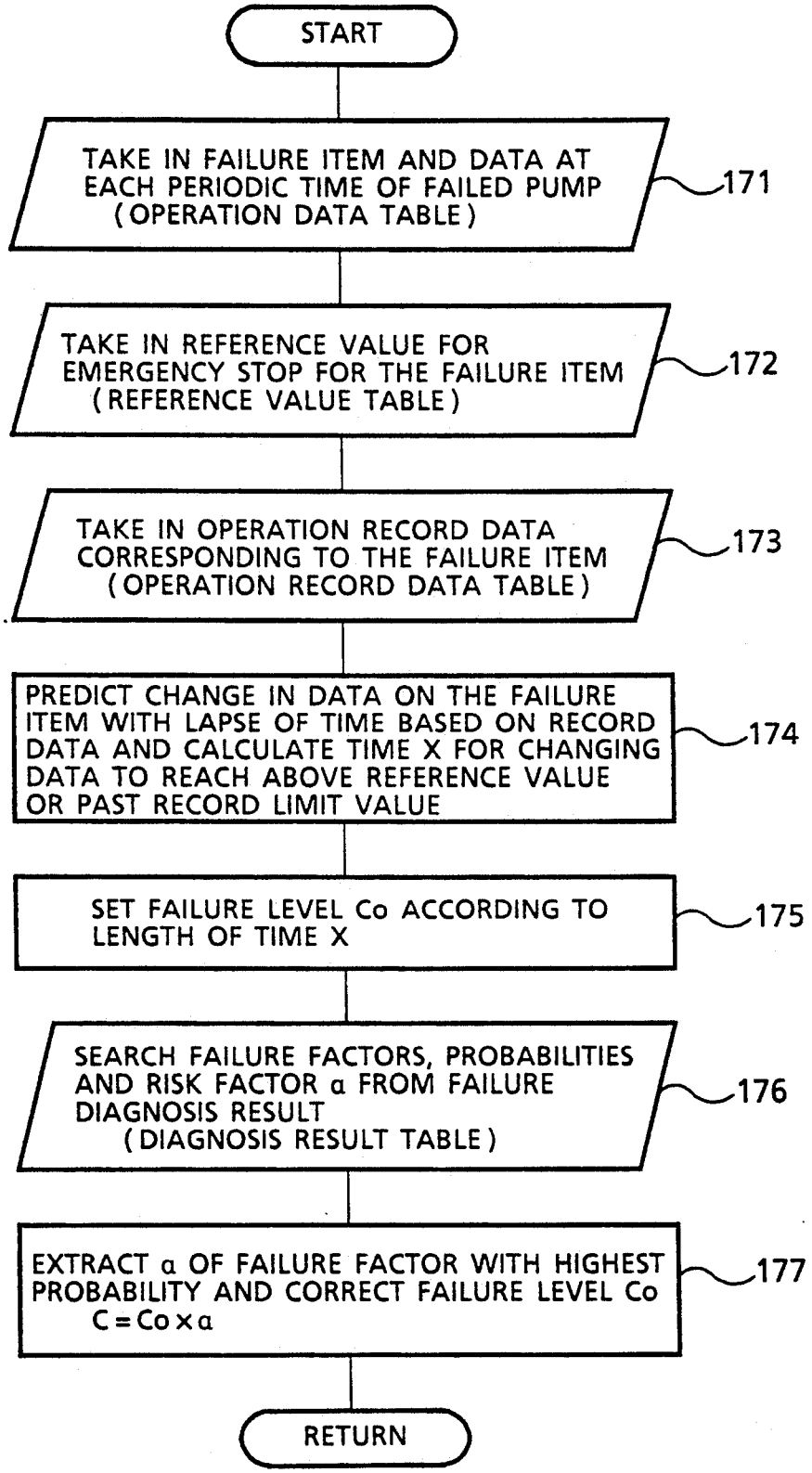
Figure 20:
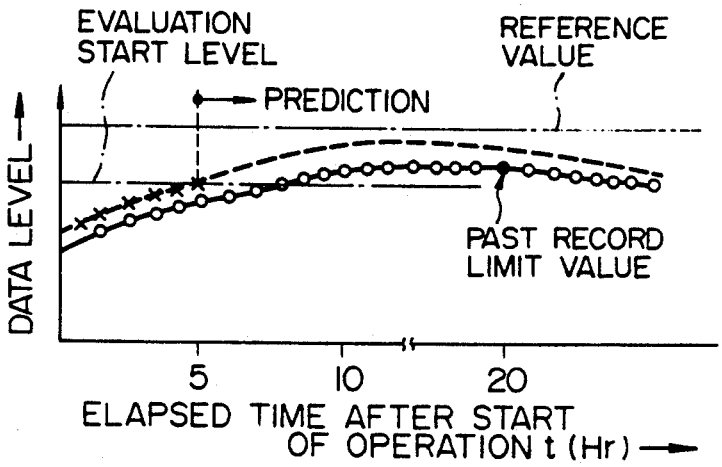
FIG. 20 to 22 are graphs for explaining manners of calculating failure levels.
Figure 21:
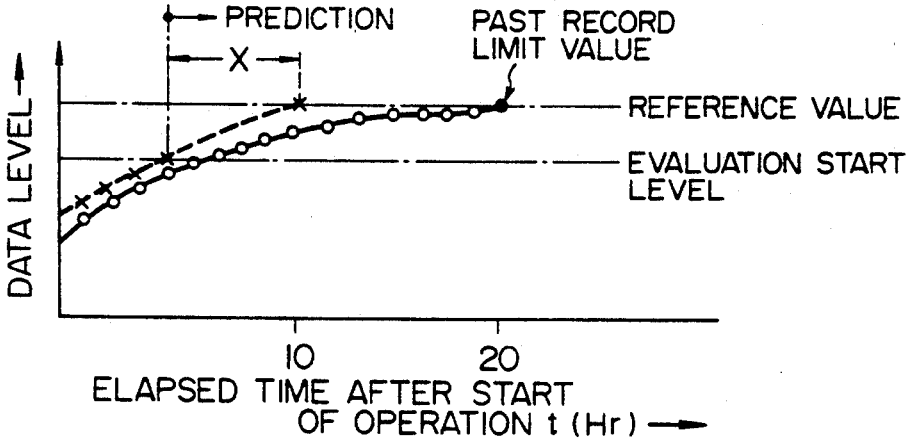
Figure 22:
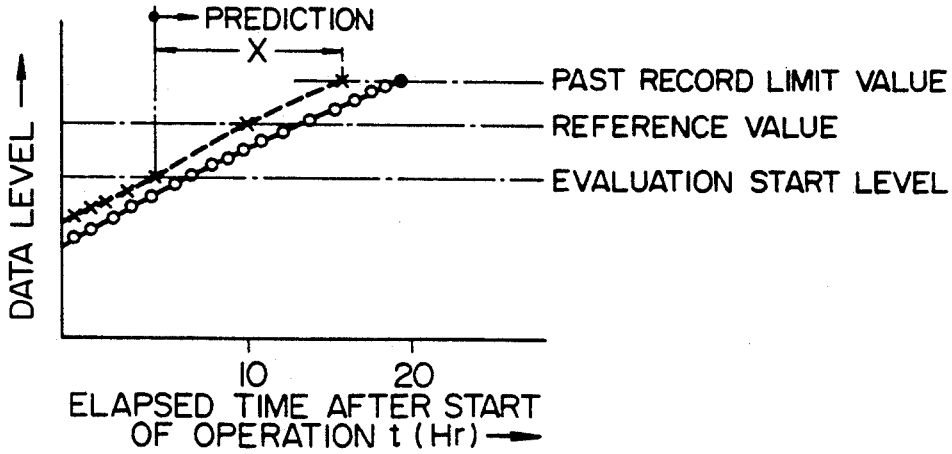

The next evaluation of the failure level is intended to add a degree of the present failure into the evaluation process, and provides the result of giving up the drainage preference operation when the failure level is high. In this embodiment, a failure level reference value for emergency stop is set at a higher level higher than the reference value for judging a major value, a period of time t taken for the measured data to reach the reference value for emergency stop from the occurrence of a failure is predicted, and the failure level C is evaluated depending on a length of the predicted period of time. This procedure is shown in FIG. 14. First, the operation data table 13 is searched in Step 171 to take in the failure item and the time-dependent data of the failed pump. Then, the reference value for emergency stop corresponding to the relevant failure item is taken from the reference value table (FIG. 19) (Step 172). In Step 173, the operation record data table 19 is searched to read the operation record data corresponding to the relevant failure item, inclusive of the time-dependent data. Thereafter, as shown in FIGS. 20, 21 and 22, a change (trend) of the present data for the relevant failure item is predicted on the basis of the operation record data, and a period of time X (minutes) taken for the predicted data to reach larger one of the reference value for emergency stop and the record limit value corresponding to the maximum value, minimum value or band in the operation record data is calculated (Step 174). While the trend of the failure data is predicted on the basis of the operation record data in this embodiment, it may be predicted from only the time-dependent data of the present failure by using extrapolation. Also, an evaluation start levels in each of FIGS. 20 to 22 corresponds to the reference value for judging a major failure, but it may be set to the reference value for judging a minor failure. After calculating the period of time X, the control flow goes to Step 175 where the failure level Co is evaluated in accordance with the preset standards. These standards are, for example, such that in the case of X=0, the reference value for emergency stop is already reached and thus Co=0.0 is set. In the case of X>60 minutes, the operation can be restarted as mentioned above and thus Co=1.0 is set. In the case of intermediate values, Co is determined by proportional allocation. Next, the diagnosis result table 25 (FIG. 17) is searched in Step 176 to extract the risk factor $\alpha$ for the failure cause with the highest probability. The extracted risk factor $\alpha$ is multiplied in Step 177 by the above Co for correction, and the process is ended by evaluating the resultant product as the final failure level C. The reason of taking into account the risk factor as well is in need of correcting those failure causes for which the failure levels judged from the data trend and/or the past record are considered to be not sufficient. A value of the risk factor is set, for example, in accordance with such standards that $\alpha=0.5$ is given for the failure cause which is expected to change abruptly, and $\alpha=1.0$ is given for the failure cause which is expected not to change abruptly or will not immediately lead to damage of the equipment even if the reference value for judging a major failure is reached. Thereafter, the control flow goes to Step 118 in FIG. 10 for determining whether the failure level C is equal to or larger than a predetermined reference value CS (e.g., 0.2). If C is equal to or larger than CS, this is judged as suggesting that the operation can be continued and, therefore, the control flow goes to next Step 119 for evaluating the normality level. If C is smaller than CS, this is judged as suggesting that the operation is difficult to continue and, therefore, the control flow goes to Step 128 where a message including the relevant situations and the evaluation result is outputted for indication.

With this embodiment, as explained above, since whether to continue the drainage preference operation or not is evaluated using the failure level determined on the basis of the operation data, the non-flexible judgment based on the fixed reference value in the prior art is avoided and human factors such as experiences of the operator are not intervened in the judging process, thus enabling to achieve the rational and high-reliable drainage preference operation. Specifically, evaluation of the failure level can be made in consideration of the operating state of the equipment, the reference value preset corresponding to the operating state, the trend pattern of the measure data, etc. and, therefore, the failed condition of the relevant equipment can be evaluated more accurately. In addition, by considering the trend pattern as well, it becomes possible to accurately predict the future trend and increase the accuracy of judgment on whether to continue the operation or not.

Furthermore, by taking the operation record data of the same or similar drain pump as or to the drain pump involved with the failure, which have been recorded under a condition of the same failure occurred before, into evaluation of the failure level, the reliability of the evaluation can be further improved.

Figure 15:
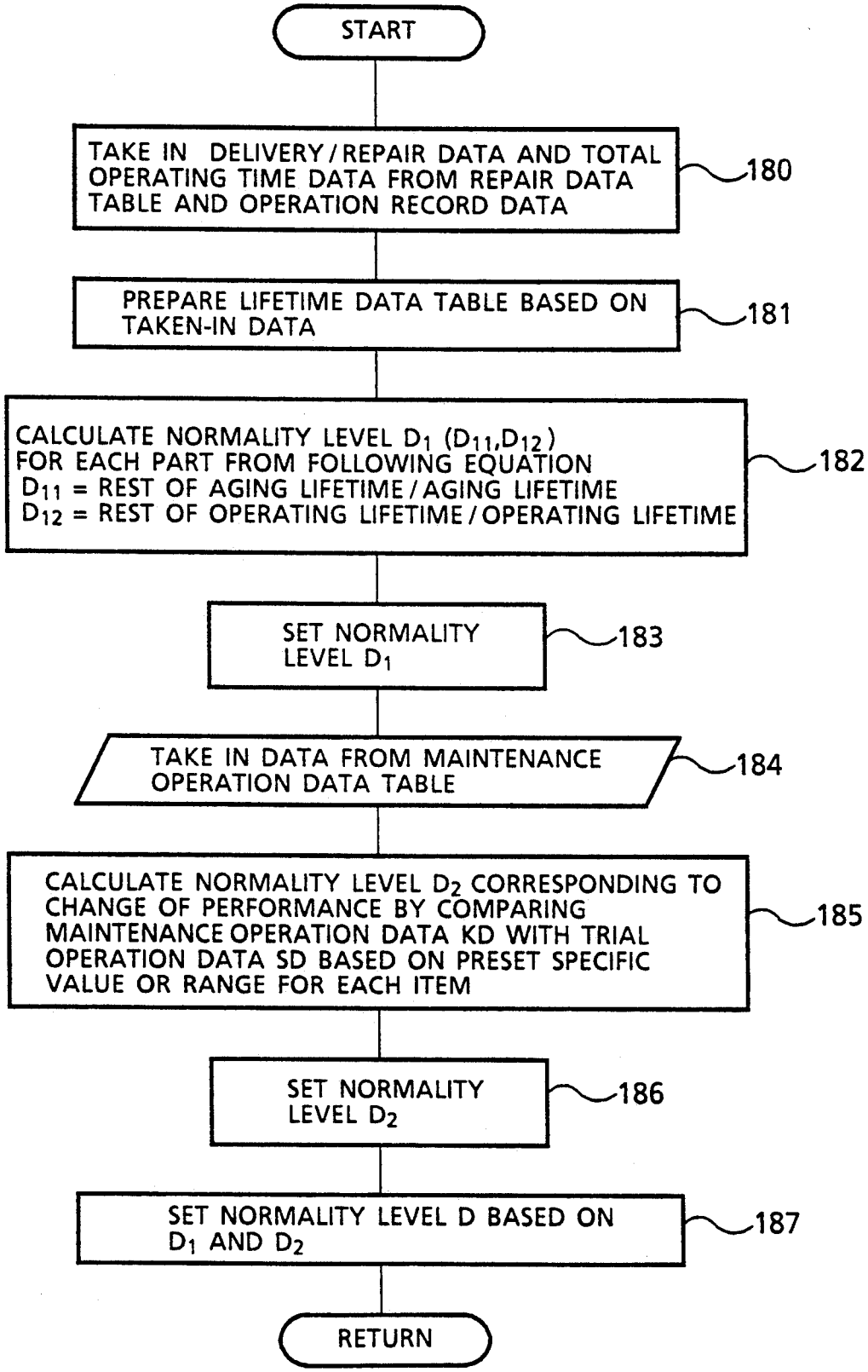

The evaluation of the normality level is intended t add how far characteristics of the failed pump is deteriorated in comparison with the fresh state, i.e., the state at the delivery time, into the evaluation process. As to the normality level, both evaluation from the standpoint of lifetime (first normality level $D_1$) and evaluation from the standpoint of characteristic deterioration in terms of the operation data (second normality level $D_2$) are both considered in this embodiment. Depending on cases, only either one level may be considered. The evaluation procedure is shown in FIG. 15. First, in Step 180, data of the delivery date, the trial operation date, and the part exchange or repair date of the failed pump are read from the repair data table 20 (FIG. 6), and the total operating time of the failed pump is read from the operation record data table 19. Then, in Step 181, the aging lifetime, the rest of the aging lifetime, the operating lifetime and the rest of the operating lifetime are calculated for each part to prepare a lifetime table as shown in FIG. 23. The aging lifetime is the expected life span which is simply consumed with the elapse of time, and has an initial value set by the maker, etc. Accordingly, the rest of the aging lifetime is given by subtracting the number of years after the delivery date from the aging lifetime. When the part is exchanged by new one in course of the due operation, the rest of the aging lifetime is returned to the initial value. When the part is repaired halfway, a half the number of years consumed, for example, is added to the present rest of the aging lifetime. On the other hand, the operating lifetime is the expected life span which concerns with the total operating time, and has an initial value preset as a guaranty value by the maker, etc. The rest of the operating lifetime is given by subtracting the total operating time from the initial value. When the part is repaired or exchanged, the rest of the operating lifetime is corrected in a like manner to the aging lifetime. Next, based on the contents of the lifetime table thus prepared and the following equation, the first normality level $D_1$ ($D_{11}$, $D_{12}$) is calculated for each part (Step 182):

$$D_{11} = \textit{rest of aging lifetime/aging lifetime} \quad (4)$$

$$D_{12} = \textit{rest of operating lifetime/operating lifetime}$$

Then, Step 183 sets minimum one of these two values as the first normality level $D_1$. After that, the maintenance operation data table 21 (FIG. 7) is searched in Step 184 to determine two values of the second normality level from the following equation based on a preset specific value or specific range, the trial operation data SD and the maintenance operation data KD for each primary data item. Then, minimum one of those two values is set as the second normality level $D_2$. Note that the maintenance operation data are collected by operating the draining pump system once per one or two months, for example, under the same condition as the trial operation.

For the specific value specified by Max $$D = (Max = KD)/(Max - SD)$$

For the specific value specified by Min $$D = (KD - Min)/(SD - Min)$$

For the specific range specified by Min − Max $$D = 1 - 4|Mean - KD|/(Max - Min)$$

Here, the normality level D is in a range of 0 to 1.0. Note that although the minimum value is selected to the normality levels $D_1$ and $D_2$ in this embodiment, it is alternatively possible to adopt the method of setting a mean value of the weighted two values as the normality level.

Based on the first and second normality levels thus determined, the final normality level D is determined in Step 187. As a method of determining D, there can be adopted any of the method of calculating the product of two values, and the method of adding weights to both values and taking a mean value thereof.

After obtaining the normality level D, the control flow returns to Step 120 in FIG. 10 where the normality level D is compared with a present reference value DS (e.g., 0.8) for normality judgment. If $D \geqq DS$ holds, the control flow goes to Step 121 to display a message including an indication to continue operation of the failed pump, conditions for the continued operation, and the evaluation result, followed by returning to the start state in FIG. 9. On the other hand, if $D < DS$ holds, this is judged as suggesting that the operation is difficult to continue and, therefore, the control flow goes to Step 128 where a message including the relevant situations and the evaluation result is outputted for indication.

With this embodiment, as explained above, since the evaluation of the normality level is made based on an index for indicating the present normality of equipment, such as the remaining lifetime of each part of the drain pump involved with the failure, the drainage preference operation can be evaluated in a more rational manner.

The processing sequence to evaluate the drainage preference operation in the case of a minor failure will be next described with reference to FIG. 11. Steps 132 to 137 in FIG. 11 are basically the same as those in the processing for a major failure shown in FIG. 10 except that the evaluation result in each step is not compared with the reference value or the like for judging whether to continue the operation or not, and the evaluation message is simply outputted for indication. Thus, explanation of those Steps is omitted here. The processing for a minor failure is largely different from the processing for a major failure in making evaluation of learning/experience. This evaluation of learning/experience is intended to register the matters, which have been learned from or experienced in the past operation by operators, into the learning/experience table and then add the contents of the learning/experience table to the process of judging whether to continue the drainage preference operation or not, when there occurs a failure of similar type. It is also possible to register knowhow possessed by the makers into the table and utilize it as with the learning/experience data. The detailed processing sequence is shown as Steps 191 to 194 in FIG. 16. The evaluation of learning/experience is performed in such a manner as not to directly present a level, but process the data in accordance with the contents of the learning/experience table and output a message, for example, 'Since vibration is reduced to VS by lowering RPM to NS, the failure level C=1.0 is resulted and the operation can be continued.' for indication. Thus, by adding the events learned or experienced by the operators and knowhow possessed by the equipment makers, the judgment on whether to continue the operation or not can be made with higher reliability. After the above evaluation, the control flow returns to Step 139 in FIG. 11 where an overall evaluation message as shown in FIG. 24 is indicated on the output means 27.

The evaluation of the drainage preference operation in this embodiment has been set forth above by dividing a failure into major one and minor one and explaining the major failure case prior to the minor failure case. This is primarily based on such a demand that the drainage operation should have preference in general principles even in the event of the occurrence of a major failure which must lead to stop of the pump. In this respect, since a minor failure usually occurs prior to a major failure, the processing of FIG. 11 is carried out before the processing of FIG. 10 so that the operator can sufficiently review the method to be taken upon the occurrence of a major failure with substantial time, based on the evaluation message indicated in the processing for the minor failure. In particular, the major failure may be avoided by taking an action in accordance with the message from the learning/experience evaluation.

In the case of a minor failure, since the condition is not so urgent as the case of a major failure, the evaluation of the operation record level and the evaluation of the normality level may be both omitted to simplify and speed up the processing.

Further, in the case of a major failure, if the final judgment on whether to continue the operation or not is made based on only the evaluation of the necessity of drainage and the evaluation of the operation record level, the processing can be speed up without deteriorating the reliability.

As fully described above, the present invention can provide the following advantages.

(1) Since whether to continue the drainage preference operation or not is evaluated using the necessity of drainage based on a period of time taken for a water level in the influent tank to reach an upper limit if operation of the drain pump involved with the failure is stopped, the rational and high-reliable judgment can be made without intervention of human factors such as experiences of the operator.

In this connection, by predicting a time-dependent change in the amount of influent water flowing into the draining pump plant and evaluating the necessity of drainage based on the predicted result, the reliability is further improved.

(2) Since the failure level is evaluated on the basis of the operation data in consideration of the operating state of equipment, a reference value corresponding to the operating state, a trend pattern of the measured data, etc. and whether to continue the drainage preference operation or not is then evaluated using the failure level, the non-flexible judgment based on the fixed reference value in the prior art is avoided and human factors such as experiences of the operator are not intervened in the judging process, thus enabling to achieve the rational and high-reliable judgment. Also, the accuracy of the judgment on whether to continue the operation or not is high.

(3) By making evaluation of whether to continue the operation or not from the standpoint of past record based o the operation record level indicating whether or not the present operation data under a failed condition fall within operation record values such as a maximum value, a minimum value and a band in the measured data which have been recorded during the past operation, and the previous execute operation, the possibility of continuing the drainage preference operation in the event of a major failure can be evaluated maximally.

(4) Since the evaluation of whether to continue the operation or not is made using the failure level in consideration of the operation record data of the same or similar drain pump as or to the drain pump involved with the failure, which have been recorded under a condition of the same failure occurred before, the reliability of the evaluation can be further improved.

(5) By evaluating the normality level which indicates the present normality of equipment such as the remaining lifetime of each part of the drain pump involved with the failure, the drainage preference operation can be evaluated in a more rational manner.

(6) By adding the events learned or experienced by operators and knowhow possessed by equipment makers for comparison with the events occurred relating to the failure, the judgment on whether to continue the operation or not can be made with higher reliability.

By combining two or more of the above evaluation elements with each other, the reliability of the judgment is further improved in addition to separate effects of the evaluation elements, making it possible to prevent unnecessary stop of the pump, pump stop in the case of needing the continued operation, and damage of the equipment due to forced operation. As a result, the pump operation with high reliability can be achieved.

What is claimed is:

1. In a draining pump system which includes a drain pump for discharging drained water, flowing into an influent tank, to a river or other watercourse, a drainage preference operating method for such a draining pump system comprises the steps of evaluating the necessity of drainage when a failure occurs in said draining pump system, and determining conditions of continuing or stopping operation of said drain pump on the basis of said evaluation.

2. In a draining pump system which includes a plurality of drain pumps for discharging drained water, flowing into an influent tank, to a river or other watercourse, prime movers for respectively driving said drain pumps, and a group of auxiliaries for said drain pumps and said prime movers, a drainage preference operating method for such a draining pump system comprises the steps of, upon the occurrence of a failure in said draining pump system, predicting a period of time taken for a water level in said influent tank to reach an upper limit if operation of the drain pump involved with the failure is stopped, evaluating the necessity of drainage depending on a length of the predicted period of time, and determining conditions of continuing or stopping operation of the failed equipment on the basis of said evaluation.

3. In a draining pump system which includes a plurality of drain pumps for discharging drained water, flowing into an influent tank, to a river or other watercourse, prime movers for respectively driving said drain pumps, and a group of auxiliaries for said drain pumps and said prime movers, a drainage preference operating method for such a draining pump system comprises the steps of, upon the occurrence of a failure in said draining pump system, predicting a time-dependent change in the data relating to the failure based on the operation data of the drain pump involved with the failure, calculating a period of time taken for the predicted data to reach a preset reference value for emergency stop relating to the failure, evaluating a failure level depending on a length of the calculated period of time, and determining conditions of continuing or stopping operation of the failed equipment on the basis of said evaluation.

4. In a draining pump system which includes a plurality of drain pumps for discharging drained water, flowing into an influent tank, to a river or other watercourse, prime movers for respectively driving said drain pumps, and a group of auxiliaries for said drain pumps and said prime movers, a drainage preference operating method for such a draining pump system comprises the steps of, upon the occurrence of a failure in said draining pump system, predicting a change in the data relating to the failure based on both the present operation data of the drain pump involved with the failure and the operation record data for the same failure occurred before, calculating periods of time taken for the predicted data to respectively reach a preset reference value for emergency stop relating to the failure and a limit value in the past operation record, evaluating a failure level depending on larger one of the two calculated periods of time, and determining conditions of continuing or stopping operation of the failed equipment on the basis of said evaluation.

5. A drainage preference operating method for a draining pump system according to claim 3, further comprising the steps of diagnosing the occurred failure to determine failure causes and probabilities of the causes, finding out the failure cause with the highest probability, and correcting said evaluation of the failure level depending on a risk factor set corresponding to the failure cause found out.

6. In a draining pump system which includes a plurality of drain pumps for discharging drained water, flowing into an influent tank, to a river or other watercourse, prime moves for respectively driving said drain pumps, and a group of auxiliaries for said drain pump and said prime movers, a drainage preference operating method for such a draining pump system comprises the steps of, upon the occurrence of a failure in said draining pump system, calculating a proportion of the remaining lifetime with respect to the rated lifetime of each equipment part of the drain pump involved with the failure, evaluating a normality level of the ailed equipment depending on the calculated proportion of the remaining lifetime, and determining conditions of continuing or stopping operation of the failed equipment on the basis of said evaluation.

7. In a draining pump system which includes a plurality of drain pumps for discharging drained water, flowing into an influent tank, to a river or other watercourse, prime movers for respectively driving said drain pumps, and a group of auxiliaries for said drain pumps and said prime movers, a drainage preference operating method for such a draining pump system comprises the steps of, upon the occurrence of a failure in said draining pump system, predicting a period of time taken for a water level in said influent tank to reach an upper limit if operation of the drain pump involved with the failure is stopped, evaluating the necessity of drainage depending on a length of the predicted period of time, and determining conditions of continuing or stopping operation of the failed equipment on the basis of said evaluation, and further comprises the steps of, when said determination indicates the operation to be continued, predicting a time-dependent change in the data relating to the failure based on the operation data of the drain pump involved with the failure, calculating a period of time taken for the predicted data to reach a preset reference value for emergency stop relating to the failure, evaluating a failure level depending on a length of the calculated period of time, and determining conditions of continuing or stopping operation of the failed equipment on the basis of said evaluation.

8. In a draining pump system which includes a plurality of drain pumps for discharging drained water, flowing into an influent tank, to a river or other watercourse, prime movers for respectively driving said drain pumps, and a group of auxiliaries for said drain pumps and said prime movers, a drainage preference operating method for such a draining pump system comprises the steps of, upon the occurrence of a failure in said draining pump system, predicting a period of time taken for a water level in said influent tank to reach an upper limit if operation of the drain pump involved with the failure is stopped, evaluating the necessity of drainage depending on a length of the predicted period of time, and determining conditions of continuing or stopping operation of the failed equipment on the basis of said evaluation, and further comprises the steps of, when said determination indicates the operation to be continued, predicting a change in the data relating to the failure based on both the present operation data of the drain pump involved with the failure and the operation record data for the same failure occurred before, calculating periods of time taken for the predicted data to respectively reach a preset reference value for emergency stop relating to the failure and a limit value in the past operation record, evaluating a failure level depending on larger one of the two calculated periods of time, and determining conditions of continuing or stopping operation of the failed equipment on the basis of said evaluation.

9. A drainage preference operating method for a draining pump according to claim 7, further comprising the steps of diagnosing the occurred failure to determine failure causes and probabilities of the causes, finding out the failure cause with the highest probability, and correcting said evaluation of the failure level depending on a risk factor set corresponding to the failure cause found out.

10. In a draining pump system which includes a plurality of drain pumps for discharging drained water, flowing into an influent tank, to a river or other watercourse, prime movers for respectively driving said drain pumps, and a group of auxiliaries for said drain pumps and said prime movers, a drainage preference operating method for such a draining pump system comprises the steps of, upon the occurrence of a failure in said draining pump system, a predicting period of time taken for a water level in said influent tank to reach an upper limit if operation of the drain pump involved with the failure is stopped, evaluating the necessity of drainage depending on a length of the predicted period of time, and determining conditions of continuing or stopping operation of the failed equipment on the basis of said evaluation, and further comprises the steps of, when said determination indicates the operation to be continued, calculating a proportion of the remaining lifetime with respect to the rated lifetime of each equipment part of the drain pump involved with the failure, evaluating a normality level of the failed equipment depending on the calculated proportion of the remaining lifetime, and determining conditions of continuing or stopping operation of the failed equipment on the basis of said evaluation.

11. In a draining pump system which includes a plurality of drain pumps for discharging drained water, flowing into an influent tank, to a river or other watercourse, prime movers for respectively driving said drain pumps, and a group of auxiliaries for said drain pumps and said prime movers, a drainage preference operating method for such a draining pump system comprises the steps of, upon the occurrence of a failure in said draining pump system, predicting a period of time taken for a water level in said influent tank to reach an upper limit if operation of the drain pump involved with the failure is stopped, evaluating the necessity of drainage depending on a length of the predicted period of time, and determining conditions of continuing or stopping operation of the failed equipment on the basis of said evaluation, further comprises the steps of, when said determination indicates the operation to be continued, predicting a change in the data relating to the failure based on both the present operation data of the drain pump involved with the failure and the operation record data for the same failure occurred before, calculating periods of time taken for the predicted data to respectively reach a preset reference value for emergency stop relating to the failure and a limit value in the past operation record, evaluating a failure level depending on larger one of the two calculated periods of time, diagnosing the occurred failure to determine failure causes and probabilities of the causes, finding out the failure cause with the highest probability, correcting said evaluation of the failure level depending on a risk factor set corresponding to the failure cause found out, and determining conditions of continuing or stopping operation of the failed equipment on the basis of said corrected evaluation, and still further comprises the steps of, when said last determination indicates the operation to be continued, calculating a proportion of the remaining lifetime with respect to the rated lifetime of each equipment part of the drain pump involved with the failure, evaluating a normality level of the ailed equipment depending on the calculated proportion of the remaining lifetime, and determining conditions of continuing or stopping operation of the failed equipment on the basis of said evaluation.

12. Ad drainage preference operating method for a draining pump system according to claim 2, further comprising the step of indicating a message inclusive of the respective evaluation results necessary for decision of whether to continue or stop operation of the drain pump involved with the failure.

13. In a draining pump system which includes a plurality of drain pumps for discharging drained water, flowing into an influent tank, to a river or other watercourse, prime movers for respectively driving said drain pumps, and a group of auxiliaries for said drain pumps and said prime movers, said draining pump system also includes a drainage preference operating and managing apparatus comprising drainage necessity evaluating means for, upon the occurrence of a failure in said draining pump system, predicting a period of time taken for a water level in said influent tank to reach an upper limit if operation of the drain pump involved with the failure is stopped, evaluating the necessity of drainage depending on a length of the predicted period of time, and determining conditions of continuing or stopping operation of the failed equipment on the basis of said evaluation.

14. In a draining pump system which includes a plurality of drain pumps for discharging drained water, flowing into an influent tank, to a river or other watercourse, prime movers for respectively driving said drain pumps, and a group of auxiliaries for said drain pumps and said prime movers, said draining pump system also includes a drainage preference operating and managing apparatus comprising:

an operation data table prepared by collecting operating state data of said draining pump system, and failure level evaluating means for, upon the occurrence of a failure in said draining pump system, searching said operation data table to extract the operation data of the drain pump associated equipment involved with the failure, predicting a time-dependent change in the data relating to the failure based on the extracted operation data, calculating a period of time taken for the predicted data to reach a preset reference value for emergency stop relating to the failure, evaluating a failure level depending on a length of the calculated period of time, and determining conditions of continuing or stopping operation of the failed equipment on the basis of said evaluation.

15. In a draining pump system which includes a plurality of drain pumps for discharging drained water, flowing into an influent tank, to a river or other watercourse, prime movers for respectively driving said drain pumps, and a group of auxiliaries for said drain pumps and said prime movers, said draining pump system also includes a drainage preference operating and managing apparatus comprising:

an operation data table prepared by collecting operating state data of said draining pump system, an operation record data table prepared by collecting past emergent operation data of the drain pump which have been recorded under a failed condition of said draining pump system, and failure level evaluating means for, upon the occurrence of a failure in said draining pump system, searching said operation data table and said operation record data table, comparing the present operation data of the drain pump involved with the failure with the past operation record data under the same failed condition of the same or similar equipment, to thereby predict a change in the data relating to the failure, calculating periods of time taken for the predicted data to respectively reach a preset reference value for emergency stop relating to the failure and a limit value in the past operation record, evaluating a failure level depending on larger one of the two calculated periods of time, and determining conditions of continuing or stopping operation of the failed equipment on the basis of said evaluation.

16. A draining pump system according to claim 14, wherein said drainage preference operating and managing apparatus further comprises failure diagnosing means for diagnosing the occurred failure to determine failure causes and probabilities of the causes, and finding out the failure cause with the highest probability, and said failure level evaluating means serves to correct said evaluation of the failure level depending on a risk factor set corresponding to the failure cause found out.

17. In a draining pump system which includes a plurality of drain pumps for discharging drained water, flowing into an influent tank, to a river or other watercourse, prime movers for respectively driving said drain pumps, and a group of auxiliaries for said drain pumps and said prime movers, said draining pump system also includes a drainage preference operating and managing apparatus comprising normality level evaluating means for, upon the occurrence of a failure in said draining pump system, calculating a proportion of the remaining lifetime with respect to the rated lifetime of each equipment part of the drain pump involved with the failure, evaluating a normality level of the failed equipment depending on the calculated proportion of the remaining lifetime, and determining conditions of continuing or stopping operation of the failed equipment on the basis of said evaluation.

18. In a draining pump system which includes a plurality of drain pumps for discharging drained water, flowing into an influent tank, to a river or other watercourse, prime movers for respectively driving said drain pumps, and a group of auxiliaries for said drain pumps and said prime movers, an operation data table prepared by collecting operating state data of said draining pump system, drainage necessity evaluating means for, upon the occurrence of a failure in said draining pump system, predicting a period of time taken for a water level in said influent tank to reach an upper limit if operation of the drain pump involved with the failure is stopped, and determining the necessity of drainage depending on a length of the predicted period of time, and failure level evaluating means for, when said necessity of drainage is not less than a setting value, searching said operation data table to extract the operation data of the drain pump associated equipment involved with the failure, predicting a time-dependent change in the data relating to the failure based on the extracted operation data, calculating a period of time taken for the predicted data to reach a preset reference value for emergency stop relating to the failure, evaluating a failure level depending on a length of the calculated period of time, and determining conditions of continuing or stopping operation of the failed equipment on the basis of said evaluation.

19. In a draining pump system which includes a plurality of drain pumps for discharging drained water, flowing into an influent tank, to a river or other watercourse, prime movers for respectively driving said drain pumps, and a group of auxiliaries for said drain pumps and said prime movers, said draining pump system also includes a drainage preference operating and managing apparatus comprising:

an operation data table prepared by collecting operating state data of said draining pump system, an operation record data table prepared by collecting emergent operation data of the drain pump which have been recorded under a failed condition of said draining pump system, drainage necessity evaluating means for, upon the occurrence of a failure in said draining pump system, predicting a period of time taken for a water level in said influent tank to reach an upper limit if operation of the drain pump involved with the failure is stopped, and determining the necessity of drainage depending on a length of the predicted period of time, and failure level evaluating means for, when said necessity of drainage is not less than a setting value, searching said operation data table and said operation record data table, comparing the present operation data of the drain pump involved with the failure with the past operation record data under the same failed condition of the same or similar equipment, to thereby predict a change in the data relating to the failure, calculating periods of time taken for the predicted data to respectively reach a preset reference value for emergency stop relating to the failure and a limit value in the past operation record, evaluating a failure level depending on larger one of the two calculated periods of time, and determining conditions of continuing or stopping operation of the failed equipment on the basis of said evaluation.

20. A draining pump system according to claim 18, wherein said drainage preference operating and managing apparatus further comprises failure diagnosing means for diagnosing the occurred failure to determine failure causes and probabilities of the causes, and finding out the failure cause with the highest probability, and said failure level evaluating means serves to correct said evaluation of the failure level depending on a risk factor set corresponding to the failure cause found out.

21. In a draining pump system which includes a plurality of drain pumps for discharging drained water, flowing into an influent tank, to a river or other watercourse, prime movers for respectively driving said drain pumps, and a group of auxiliaries for said drain pumps and said prime movers, said draining pump system also includes a drainage preference operating and managing apparatus comprising:

drainage necessity evaluating means for, upon the occurrence of a failure in said draining pump system, predicting a period of time taken for a water level in said influent tank to reach an upper limit if operation of the drain pump involved with the failure is stopped, and determining the necessity of drainage depending on a length of the predicted period of time, and normality level evaluating means for, when said necessity of drainage is not less than a setting value, calculating a proportion of the remaining lifetime with respect to the rated lifetime of each equipment pat of the drain pump involved with the failure, evaluating a normality level of the failed equipment depending on the calculated proportion of the remaining lifetime, and determining conditions of continuing or stopping operation of the failed equipment on the basis of said evaluation.

22. A draining pump system according to claim 21, wherein said drainage preference operating and managing apparatus further comprises a maintenance operation data table prepared by collecting trial operation data and subsequent maintenance operation data of said draining pump system, and said normality level evaluating means searches said maintenance operation data table, determine a change in performance of said drain pump associated equipment involved with failure from the data relating to the failure, and correct said evaluation of the normality level depending on said determined change in performance.

23. In a draining pump system which includes a plurality of drain pumps for discharging drained water, flowing into an influent tank, to a river or other watercourse, prime movers for respectively driving said drain pumps, and a group of auxiliaries for said drain pumps and said prime movers, said draining pump system also includes a drainage preference operating and managing apparatus comprising:

an operation data table prepared by collecting operating state data of said draining pump system, an operation record data table prepared by collecting emergent operation data of the drain pump which have been recorded under a failed condition of said draining pump system, a repair data table storing data of the delivery date and the repair contents of component equipment of said draining pump system, a maintenance operation data table prepared by collecting trial operation data and subsequent maintenance operation data of said draining pump system, drainage necessity evaluating means for, when a failure detection signal of said draining pump system is applied, predicting a period of time taken for a water level in said influent tank to reach an upper limit if operation of the drain pump involved with the failure is stopped, and determining the necessity of drainage depending on a length of the predicted period of time, failure level evaluating means for, when said necessity of drainage is not less than a setting value, searching said operation data table and said operation record data table, comparing the present operation data of the drain pump involved with the failure with the past operation record data under the same failed condition of the same or similar equipment, to thereby predict a change in the data relating to the failure, calculating periods of time taken for the predicted data to respectively reach a preset reference value for emergency stop relating to the failure and a limit value in the past operation record, and determining a failure level depending on larger one of the two calculated periods of time, and normality level evaluating means for, when said failure level is not less than a setting value, searching said repair table, calculating a proportion of the remaining lifetime with respect to the rated lifetime of each equipment part of the drain pump involved with the failure, evaluating a first normality level of the failed equipment depending on the calculated proportion of the remaining lifetime, searching said maintenance operation data table, determining change in performance of the failed equipment from the data relating to the failure, evaluating a second normality level depending on said determined change in performance, and determining conditions of continuing or stopping operation of the failed equipment on the basis of said first and second normality levels.

24. A draining pump system according to claim 13, wherein said drainage preference operating and managing apparatus further comprises display means for outputting and indicating a message and at least one of the necessity of drainage, the presence or absence of a spare of the drain pump involved with the failure, the presence or absence of the operation record under the failed condition, the failure level, the operation continuable time, the failure causes, the risk factor and the normality level which are necessary for decision of whether to continue or stop operation of the drain pump involved with the failure.

25. In a draining pump system which includes a drain pump for discharging drained water, flowing into an influent tank, to a river or other watercourse, a prime mover for driving said drain pump, and a group of auxiliaries for said drain pump and said prime mover, said draining pump system also includes a drainage preference operating and managing apparatus comprising:

an operation data table prepared by collecting operating state data of the drain pump associated equipment inclusive of said drain pump, said prime mover and said group of auxiliaries, an operation record data table prepared by collecting emergent operation data which have been recorded under a failed condition of said drain pump associated equipment, drainage necessity evaluating means for, when a failure detection signal of said drain pump associated equipment is applied, predicting an influence given to a drainage function of said draining pump system, and determining the necessity of drainage based on said prediction, operation record evaluating means for, when said necessity of drainage is not less than a setting value, searching said operation record data table and indicating the presence of the operation record if the present state of the failure falls within a range of the operation record data recorded under the same failed condition of the same or similar equipment as or to said drain pump associated equipment involved with the failure, and failure level evaluating means for, when said operation record is present, searching said operation data table and said operation record data table, comparing the present operation data of said drain pump associated equipment involved with the failure with the past operation record data under the same failed condition of the same or similar equipment, to thereby predict a change in the data relating to the relevant failure item, calculating periods of time taken for the predicted data to respectively reach a preset reference value for emergency stop relating to the failure and a limit value in the past operation record, evaluating a failure level depending on a value of larger one of the two calculated periods of time, and determining conditions of continuing or stopping operation of the failed equipment on the basis of said evaluation.

26. In a draining pump system which includes a drain pump for discharging drained water, flowing into an influent tank, to a river or other watercourse, a prime mover for driving said drain pump, and a group of auxiliaries for said drain pump and said prime mover, said draining pump system also includes a drainage preference operating and managing apparatus comprising:

an operation data table prepared by collecting operating state data of the drain pump associated equipment inclusive of said drain pump, said prime mover and said group of auxiliaries, an operation record data table prepared by collecting emergent operation data which have been recorded under a failed condition of said drain pump associated equipment, a repair data table storing data of the delivery date and the repair contents of said drain pump associated equipment, a maintenance operation data table prepared by collecting trial operation data and subsequent maintenance operation data of said drain pump associated equipment, failure diagnosing means for, when a failure occurs in said drain pump associated equipment, diagnosing the occurred failure to determine failure causes and probabilities of the causes, finding out the failure cause with the highest probability, extracting a risk factor set corresponding to said failure cause found out, and storing the extracted risk factor in a diagnosis result table, drainage necessity evaluating means for, when a failure detection signal of said drain pump associated equipment is applied, predicting an influence given to a drainage function of said draining pump system, and determining the necessity of drainage based on said prediction, operation record evaluating means for, when said necessity of drainage is not less than a setting value, searching said operation record data table and indicating the presence of the operation record if the present state of the failure falls within a range of the operation record data recorded under the same failed condition of the same or similar equipment as or to said drain pump associated equipment involved with the failure, failure level evaluating means for, when said operation record is present, searching said operation data table and said operation record data table, comparing the present operation data of said drain pump associated equipment involved with the failure with the past operation record data under the same failed condition of the same or similar equipment, to thereby predict a change in the data relating to the relevant failure item, calculating periods of time taken for the predicted data to respectively reach a preset reference value for emergency stop relating to the failure and a limit value in the past operation record, determining a failure level depending on a value of larger one of the two calculated periods of time, and correcting the failure level based on the risk factor in said diagnosis result table, and normality level evaluating means for, when said failure level i snot less than a setting value, searching said repair table, calculating a proportion of the remaining lifetime with respect to the rated lifetime of each equipment part of said drain pump associated equipment involved with the failure, evaluating a first normality level of said failed equipment depending on the calculated proportion of the remaining lifetime, searching said maintenance operation data table, determining a change in performance of the failed equipment form the data relating to the relevant failure item, evaluating a second normality level depending on said determined change in performance, and determining conditions of continuing or stopping operation of said drain pump on the basis of said first and second normality levels.

27. A draining pump system according to claim 25, wherein said drainage preference operating and managing apparatus further comprises display means for outputting and indicating a message and at least one of the necessity of drainage, the presence or absence of a spare of the drain pump involved with the failure, the presence or absence of the operation record under the failed condition, the failure level, the operation continuable time, the failure causes, the risk factor and the normality level.

28. In a draining pump system which includes a drain pump for discharging drained water, flowing into an influent tank, to a river or other watercourse, in a draining preference operating method for such a draining pump system comprises the step of determining, when a failure occurs in said draining pump system, conditions of continuing or stopping operation of said drain pump involved with the failure pump on the basis of the present necessity of drainage.

* * * * *